US006051350A

United States Patent [19]

Inaba et al.

[11] Patent Number: 6,051,350

[45] Date of Patent: Apr. 18, 2000

[54] IMAGE FORMING METHOD

[75] Inventors: Koji Inaba; Yuji Moriki, both of Susono; Michihisa Magome, Shizuoka-ken, all of Japan

[73] Assignee: Canon Kabushiki Kaisha

[21] Appl. No.: 09/334,652

[22] Filed: Jun. 17, 1999

[30] Foreign Application Priority Data

Jun. 18, 1998 [JP] Japan ..... 10-171230

[51] Int. Cl.[7] ..... G03G 13/01; G03G 13/22

[52] U.S. Cl. ..... 430/45; 430/47

[58] Field of Search ..... 430/45

[56] References Cited

U.S. PATENT DOCUMENTS

| | | | |
|---|---|---|---|
| 4,828,950 | 5/1989 | Crandall | 430/47 |
| 5,698,354 | 12/1997 | Ugai et al. | 430/47 |
| 5,733,692 | 3/1998 | Nagase et al. | 430/45 |
| 5,756,244 | 5/1998 | Omatsu et al. | 430/45 |

*Primary Examiner*—Roland Martin
*Attorney, Agent, or Firm*—Fitzpatrick, Cella, Harper & Scinto

[57] ABSTRACT

In an image forming method for forming multi-color images or full-color images, first to third or fourth toners are used, and the amount of cross-linking agent contained in each of the toners becomes larger in the order of the toners laid on a recording sheet. Each of the toners has a color different from the others, the color selected from yellow, cyan, magenta and black.

62 Claims, 6 Drawing Sheets

IMAGE FORMING METHOD

BACKGROUND OF THE INVENTION

1. Field of the Invention

This invention relates to an image forming method of forming multi-color images or full-color images by electrophotography.

2. Related Background Art

A commonly available full-color image forming method will be described. A photosensitive drum which is an electrostatic latent image bearing member is electrostatically uniformly charged by means of a primary charging assembly, and imagewise exposure is carried out using laser light modulated by magenta image signals of an original, to form an electrostatic latent image on the photosensitive drum. The electrostatic latent image is developed by means of a magenta developing assembly holding a magenta toner, to form a magenta toner image. Next, to a transfer medium (a recording sheet) transported, the magenta toner image formed on the photosensitive drum is transferred by means of a transfer charging assembly.

The photosensitive drum on which the electrostatic latent image has been developed is de-charged by means of a residual charge eliminator, and is further cleaned through a cleaning means. Thereafter, it is again electrostatically charged by the primary charging assembly, and a cyan toner image is similarly formed. The cyan toner image is transferred to the transfer medium on which the magenta toner image has been transferred, and then a yellow toner image and a black toner image are successively formed and developed so that the four color toner images are transferred to the transfer medium. The transfer medium having these four color toner images is passed through fixing rollers so that they are fixed to the transfer medium by the action of heat and pressure. Thus, a full-color image is formed.

The toners used in the color image forming method are required to have good melt properties and color-mixing properties when heat is applied at the time of fixing, and also to have a low melting point and sharp melt properties in a low melt viscosity. Use of such toners are preferred.

Use of the toners having sharp melt properties makes it possible to broaden the range of color reproduction of copied matter and obtain color copies faithful to original images.

Such toners having high sharp melt properties, however, have so high an affinity for the fixing roller that it tends to cause offset to the fixing roller during fixing.

In particular, in the case of a fixing assembly in full-color image forming apparatus, such offset especially tends to occur since a plurality of toner layers corresponding to magenta toner, cyan toner, yellow toner and black toner are formed on the transfer medium.

Accordingly, in order to improve releasability of toner from fixing rollers, a release agent such as silicone oil has been applied to the fixing rollers. Such an image forming method, however, has caused such problems that the toner image fixing system in which the release agent such as silicone oil is applied to fixing rollers complicates the constitution of the main body, as a matter of course, and also the application of oil shortens the lifetime of fixing rollers acceleratingly.

In addition, in recent years, a need for various modes of copying is accompanied by a rapid increase in demand for double-side copying and copying on various materials.

Under such circumstances, it is greatly expected to more improve fixing systems and to develop toners that may cause no trouble in double-side copying and also have a fixing performance good enough to be adaptable to various materials.

Usually, when double-side copying of a color image is performed, toner images formed by development in developing means are transferred onto a transfer medium, and the toner images, which are unfixed, are fixed by means of a fixing means. Thereafter, the transfer medium is discharged from the fixing means and is subsequently transported again to the transfer zone in such a state that it is turned upside down. Then, the toner images formed by development in developing means are transferred onto the transfer medium on the side opposite to the fixed image side, and the unfixed images are fixed by means of the fixing means, thus double-side color copying is completed.

In the case where, however, the double-side color copying is performed as described above, while the transfer medium (paper) having the images first transferred and fixed is transported for the second-time transfer, the paper may curl to cause a problem of paper jam during the transport.

Recently, it has also become popular to take color copies on thick paper (cardboard) as typified by postcards. In adaptation to such materials to which heat is hard to apply at the time of fixing, fixed images may become "blistered" when secondary colors are fixed in which a large quantity of red, green and blue toners are transferred.

Further continuous paper feed of such cardboard may bring about low-temperature offset to cause a phenomenon of blank areas.

Thus, in the formation of full-color images, there is still much room for improvement, and further studies are being made.

SUMMARY OF THE INVENTION

An object of the present invention is to provide an image forming method in which the above problems have been solved.

Another object of the present invention is to provide an image forming method that may less cause paper curl and may cause no paper jam during paper transport when paper is transported for double-side fixing.

Still another object of the present invention is to provide an image forming method that may cause no blistered images due to low-temperature offset when toner images are fixed on cardboad.

A further object of the present invention is to provide an image forming method that may cause no blank areas due to low-temperature offset when toner images are continuously fixed onto cardboad.

To achieve the above objects, the present invention provides an image forming method comprising;

forming a first electrostatic latent image on a latent image bearing member, developing the first electrostatic latent image by the use of a first toner to form a first toner image on the latent image bearing member and transferring the first toner image to an intermediate transfer member;

forming a second electrostatic latent image on the latent image bearing member, developing the second electrostatic latent image by the use of a second toner to form a second toner image on the latent image bearing member and transferring the second toner image to the intermediate transfer member;

forming a third electrostatic latent image on the latent image bearing member, developing the third electrostatic latent image by the use of a third toner to form a third toner image on the latent image bearing member and transferring the third toner image to the intermediate transfer member;

transferring to a recording sheet the toner images superimposed on the intermediate transfer member in the order of the first toner image, second toner image and third toner image from the surface of the intermediate transfer member; and heat-and-pressure fixing to the recording sheet the toner images superimposed on the recording sheet in the order of the third toner image, second toner image and first toner image from the surface of the recording sheet, by a heat-and-pressure fixing means to form a multi-color image or full-color image on the recording sheet;

wherein;

the toners forming the first toner image, second toner image and third toner image each contain a vinyl polymer cross-linked with a cross-linking agent or a vinyl copolymer cross-linked with a cross-linking agent; the amount of the cross-linking agent in the third toner, second toner and first toner being made larger in this order;

the first toner is a color toner selected from the group consisting of a yellow toner having yellow toner particles and an external additive, a cyan toner having cyan toner particles and an external additive, and a magenta toner having magenta toner particles and an external additive;

the second toner is a color toner selected from the group consisting of a yellow toner having yellow toner particles and an external additive, a cyan toner having cyan toner particles and an external additive, and a magenta toner having magenta toner particles and an external additive;

the third toner is a color toner selected from the group consisting of a yellow toner having yellow toner particles and an external additive, a cyan toner having cyan toner particles and an external additive and a magenta toner having magenta toner particles and an external additive; and the first toner, second toner and third toner have colors different from one another.

The present invention also provides an image forming method comprising;

forming a first electrostatic latent image on a latent image bearing member, developing the first electrostatic latent image by the use of a first toner to form a first toner image on the latent image bearing member and transferring the first toner image to a recording sheet;

forming a second electrostatic latent image on the latent image bearing member, developing the second electrostatic latent image by the use of a second toner to form a second toner image on the latent image bearing member and transferring the second toner image to the recording sheet;

forming a third electrostatic latent image on the latent image bearing member, developing the third electrostatic latent image by the use of a third toner to form a third toner image on the latent image bearing member and transferring the third toner image to the recording sheet; and heat-and-pressure fixing to the recording sheet the toner images superimposed on the recording sheet in the order of the first toner image, second toner image and third toner image from the surface of the recording sheet, by a heat-and-pressure fixing means to form a multi-color image or full-color image on the recording sheet;

wherein;

the toners forming the first toner image, second toner image and third toner image each contain a vinyl polymer cross-linked with a cross-linking agent or a vinyl copolymer cross-linked with a cross-linking agent; the amount of the cross-linking agent in the first toner, second toner and third toner being made larger in this order;

the first toner is a color toner selected from the group consisting of a yellow toner having yellow toner particles and an external additive, a cyan toner having cyan toner particles and an external additive and a magenta toner having magenta toner particles and an external additive;

the second toner is a color toner selected from the group consisting of a yellow toner having yellow toner particles and an external additive, a cyan toner having cyan toner particles and an external additive and a magenta toner having magenta toner particles and an external additive;

the third toner is a color toner selected from the group consisting of a yellow toner having yellow toner particles and an external additive, a cyan toner having cyan toner particles and an external additive and a magenta toner having magenta toner particles and an external additive; and the first toner, second toner and third toner have colors different from one another.

The present invention still also provides an image forming method comprising;

forming a first electrostatic latent image on a latent image bearing member, developing the first electrostatic latent image by the use of a first toner to form a first toner image on the latent image bearing member and transferring the first toner image to an intermediate transfer member;

forming a second electrostatic latent image on the latent image bearing member, developing the second electrostatic latent image by the use of a second toner to form a second toner image on the latent image bearing member and transferring the second toner image to the intermediate transfer member;

forming a third electrostatic latent image on the latent image bearing member, developing the third electrostatic latent image by the use of a third toner to form a third toner image on the latent image bearing member and transferring the third toner image to the intermediate transfer member;

forming a fourth electrostatic latent image on the latent image bearing member, developing the fourth electrostatic latent image by the use of a fourth toner to form a fourth toner image on the latent image bearing member and transferring the fourth toner image to the intermediate transfer member;

transferring to a recording sheet the toner images superimposed on the intermediate transfer member in the order of the first toner image, second toner image, third toner image and fourth toner image from the surface of the intermediate transfer member; and heat-and-pressure fixing to the recording sheet the toner images superimposed on the recording sheet in the order of the fourth toner image, third toner image, second toner image and first toner image from the surface of the recording sheet, by a heat-and-pressure fixing means to form a multi-color image or full-color image on the recording sheet;

wherein;

the toners forming the first toner image, second toner image, third toner image and fourth toner image each contain a vinyl polymer cross-linked with a cross-linking agent or a vinyl copolymer cross-linked with a cross-linking agent; the amount of the cross-linking agent in the fourth toner, third toner, second toner and first toner being made larger in this order;

the first toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the second toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the third toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the fourth toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive; and the first toner, second toner, third toner and fourth toner have colors different from one another.

The present invention still also provides an image forming method comprising;

forming a first electrostatic latent image on a latent image bearing member, developing the first electrostatic latent image by the use of a first toner to form a first toner image on the latent image bearing member and transferring the first toner image to a recording sheet;

forming a second electrostatic latent image on the latent image bearing member, developing the second electrostatic latent image by the use of a second toner to form a second toner image on the latent image bearing member and transferring the second toner image to the recording sheet;

forming a third electrostatic latent image on the latent image bearing member, developing the third electrostatic latent image by the use of a third toner to form a third toner image on the latent image bearing member and transferring the third toner image to the recording sheet;

forming a fourth electrostatic latent image on the latent image bearing member, developing the fourth electrostatic latent image by the use of a fourth toner to form a fourth toner image on the latent image bearing member and transferring the fourth toner image to the recording sheet; and heat-and-pressure fixing to the recording sheet the toner images superimposed on the recording sheet in the order of the first toner image, second toner image, third toner image and fourth toner image from the surface of the recording sheet, by a heat-and-pressure fixing means to form a multi-color image or full-color image on the recording sheet;

wherein;

the toners forming the first toner image, second toner image, third toner image and fourth toner image each contain a vinyl polymer cross-linked with a cross-linking agent or a vinyl copolymer cross-linked with a cross-linking agent; the amount of the cross-linking agent in the first toner, second toner, third toner and fourth toner being made larger in this order;

the first toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the second toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the third toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the fourth toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive; and the first toner, second toner, third toner and fourth toner have colors different from one another.

DESCRIPTION OF THE PREFERRED EMBODIMENTS

Figure 1:
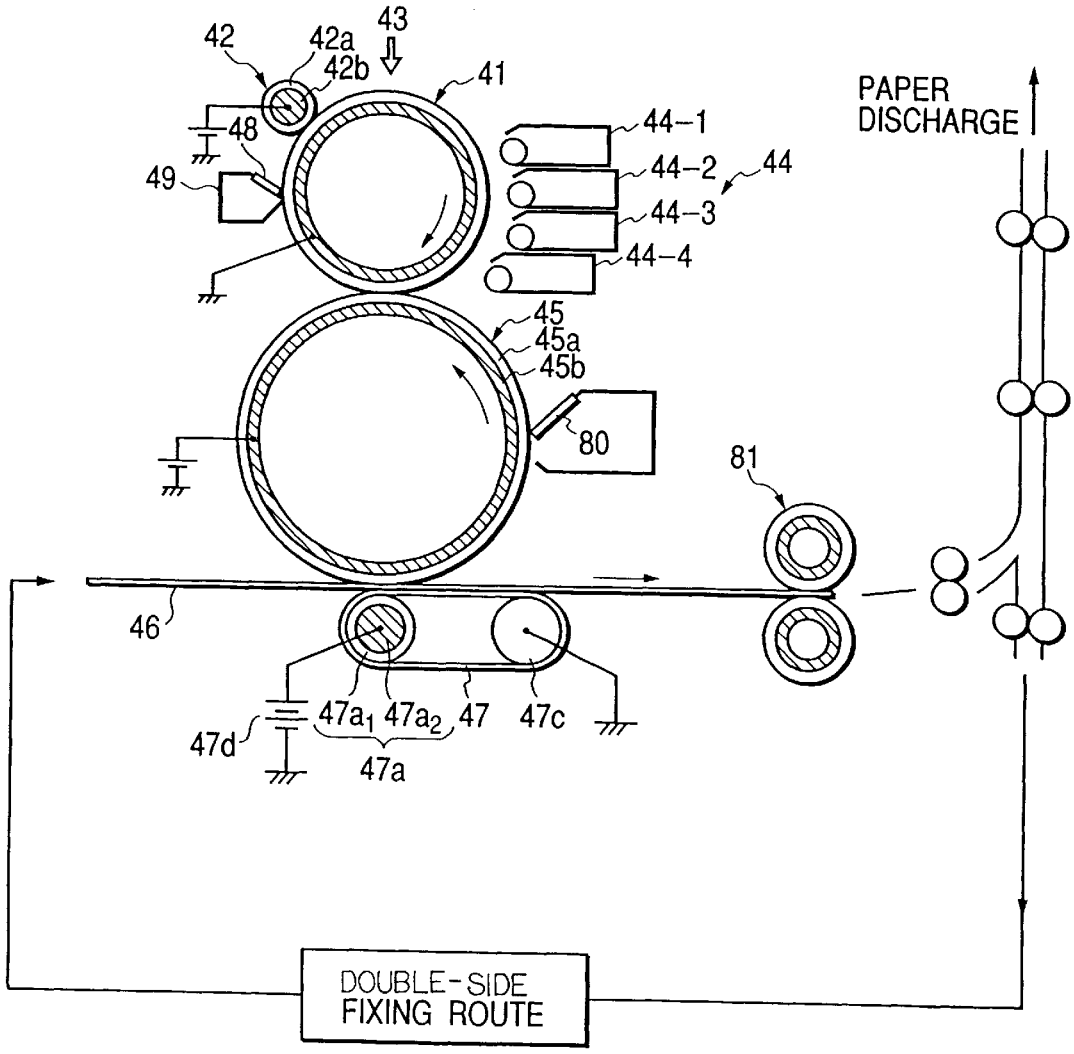
FIG. 1 schematically illustrates an image forming apparatus used to form full-color images by the method of the present invention.

The present invention is an image forming method characterized in that the amount of a cross-linking agent in each color toner is made larger in order from the recording sheet side. This broadens the latitude of low-temperature anti-offset properties. Hence, even when toner images are fixed on cardboad to which heat is hard to apply at the time of fixing, the toner layer which is closest to the recording sheet side stands weakly cross-linked to have a strong affinity for the recording sheet paper, making it possible to obtain images free of blistering or blank areas caused by low-temperature offset.

Due to such a constitution that the amount of a cross-linking agent in each color toner is made larger in order from the recording sheet side, the fixed toner layers of a multi-color or full-color image have a hard upper layer and a soft lower layer, so that the upper layer can be made to shrink in a small measure when its volume shrinkage is brought about by the natural cooling of toner binder after the heat-and-pressure fixing, making it possible to restrain the paper from curling.

The cross-linking agent used in the present invention may include aromatic divinyl compounds such as divinylbenzene and divinylnaphthalene; carboxlates having two double bonds such as ethylene glycol diacrylate, ethylene glycol dimethacrylate and 1,3-butanediol dimethacrylate; divinyl compounds such as divinylaniline, divinyl ether, divinyl sulfide and divinyl sulfone; and compounds having three or more vinyl groups. Divinylbenzene is particularly preferred.

The cross-linking agent may preferably be added in an amount of from 0.01 to 1.0 part by weight, and more preferably from 0.1 to 0.9 part by weight, based on 100 parts by weight of the vinyl polymer or vinyl copolymer.

When added in an amount less than 0.01 part by weight, fixing performance may be poor on the high-temperature side, tending to cause gloss unevenness between the front and the back especially at the time of double-side fixing. When added in an amount more than 1.0 part by weight, the transparency of OHP films tends to be damaged in multi-color images or full-color images.

The amount of the cross-linking agent correlates with the content of THF-insoluble matter in a binder resin contained in each toner, and the proportion of THF-insoluble matter in the binder resin governs the degree of cross-linking of the binder resin of each toner.

In the toners used in the present invention, the binder resin may preferably have THF(tetrahydrofuran)-insoluble matter in a content of 90% by weight or less, more preferably 70% by weight or less, and most preferably 65% by weight or less. In an instance where the toners are produced by a process having a kneading step therein, the binder resin may preferably have THF-insoluble matter in a content of 30% by weight or less, more preferably 20% by weight or less, and most preferably 15% by weight or less.

The THF-insoluble matter of the binder resin is defined to be a value measured in the following way.

Binder resin is weighed in an amount of about 1 g ($W_1$ g), which is then put in a cylindrical filter paper (e.g., No. 86R, available from Toyo Roshi K.K.) and set on a Soxhlet extractor. Extraction is carried out for 6 hours using from 100 to 200 ml of THF as a solvent, and the soluble component extracted is evaporated, followed by vacuum drying at 100° C. for several hours. Then the THF-soluble resin component is weighed ($W_2$ g). The THF-insoluble matter of the binder resin is calculated from the following expression.

$$\text{THF-insoluble matter (\% by weight) of binder resin}=\{(W_1-W_2)/W_1\}\times 100$$

The content of THF-insoluble matter in binder resin at the stage of starting materials may change when the materials are melt-kneaded in the stage of toner production. Hence, in order to measure the THF-insoluble matter of the binder resin in the toner, the content of THF-soluble matter and THF-insoluble matter in the binder resin must be measured.

The THF-soluble matter of the binder resin contained in the toner is determined by setting the toner on a Soxhlet extractor making use of toluene, and extracting toluene-soluble matter, which is separated using THF after the extract is solidified.

Thus, the content of THF-insoluble matter in the binder resin constituting the toner is measured in the following way: Toner is weighed in an amount of about 1 g ($W_3$ g), which is then put in a cylindrical filter paper (for example, No. 86R, available from Toyo Roshi K.K.) and set on a Soxhlet extractor. Extraction is carried out for 6 hours using from 100 to 200 ml of THF as a solvent, and the soluble component extracted by the use of the solvent THF is evaporated, followed by vacuum drying at 100° C. for several hours. Then the THF-soluble resin component is weighed ($W_4$ g). The weight of components other than the resin components, such as magnetic material and wax contained in the toner, is previously measured and is represented by $W_5$ g. The THF-insoluble matter is determined from the following expression.

$$\text{THF-insoluble matter (\% by weight) of binder resin in toner}=[\{W_3-(W_5+W_4)\}/(W_3-W_5)]\times 100$$

The THF-insoluble matter of the binder resin indicates the weight proportion of an ultra-high polymer component that has become insoluble in THF solvent (i.e., substantially a cross-linked high polymer), and can be a standard for measuring the degree of cross-linking of the binder resin and also a standard for estimating the quantity of the cross-linking agent added and its effect.

In the case when the toners are produced by polymerization as described later, the content of THF-insoluble matter in the binder resin increases with an increase in the quantity of the cross-linking agent used.

Hence, in an instance where, e.g., four color toners yellow toner, cyan toner, magenta toner and black toner are all produced by polymerization, the amount of the cross-linking agent added when the respective toners are produced may be adjusted, whereby the degree of cross-linking of the binder resin in each toner can be adjusted. Thus, the amount of the cross-linking agent becomes larger in the order of the toner images formed on the recording sheet, whereby the toners can be made to have a higher degree of cross-linking and a larger content of THF-insoluble matter as they come apart from the recording sheet. As the result, a good image free of blistering or blank areas can be formed and the paper can be restrained from curling, thus the objects of the present invention can be achieved.

Meanwhile, in the instance where the toners are produced by a process having a kneading step therein, the polymer chains of cross-linked polymers in the binder resin are cut, and hence the content of THF-insoluble matter of the binder resin in each toner may become small. In such an instance, what also serves as the standard for estimating the quantity and effect of the cross-linking agent added is the quantity of high-molecular weight components of THF-soluble matter in addition to the quantity of THF-insoluble matter.

In an instance where one toner only is produced by a pulverization process having a kneading step therein, e.g., three color toners yellow toner, cyan toner and magenta toner are produced by polymerization and black toner only is produced by pulverization, the content of THF-insoluble matter of the binder resin in the black toner may become smaller than those of other toners even if the cross-linking agent is added in a larger quantity in the production of the binder resin of black toner than in the production of those of other three color toners. However, in the measurement of molecular weight distribution in THF-soluble matter in such an instance, the binder resin in the black toner has a larger number-average molecular weight (Mn) than other color toners. The present inventors consider that the component present in a large quantity in this THF-soluble matter contributes to the achievement of the objects of the present invention such that the good images free of blistering or blank areas can be formed and the paper can be restrained from curling.

The number-average molecular weight (Mn) of THF-soluble matter is measured in the following way.

Columns are stabilized in a heat chamber of 40° C. To the columns kept at this temperature, THF (tetrahydrofuran) as a solvent is flowed at a flow rate of 1 ml per minute, and about 100 $\mu$l of THF sample solution is injected thereinto to make measurement. In measuring the molecular weight of the sample, the molecular weight distribution ascribed to the sample is calculated from the relationship between the logarithmic value and number of count of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Toso Co., Ltd. or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H ($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

The sample is prepared in the following way: The sample is put in tetrahydrofuran (THF), and is left for several hours, followed by thorough shaking so as to be well mixed with the THF (until coalescent matters of the sample has disappeared), which is further left standing for at least 12 hours. At this time, the sample is so allowed as to stand in THF for at least 24 hours in total. Thereafter, the solution having been passed through a sample-treating filter (pore size: 0.45 to 0.5 $\mu$m; for example, MAISHORI DISK-25-5, available from Toso Co., Ltd. or EKIKURO DISK 25CR, available from German Science Japan, Ltd., can be utilized) is used as the sample for GPC. The sample is so adjusted as to have resin components in a concentration of from 0.5 to 5 mg/ml.

The yellow toner, magenta toner and cyan toner used in the present invention may contain wax. The wax may preferably be a wax which is solid at room temperature. There is no limitation by either polymerization toners or pulverization toners. Stated specifically, it may specifically include paraffin wax, polyolefin wax, Fischer-Tropsch wax, amide waxes, higher fatty acids, higher alcohol ester waxes, and derivatives thereof such as graft compounds or block compounds thereof.

Ester waxes having at least one long-chain ester moiety having at least 10 carbon atoms as shown by the following structural formulas are particularly preferred as being effective for the high temperature anti-offset properties without impairment of the transparency required for OHP.

Ester Wax General Structural Formula (1)

$$[R_1—COO—(CH_2)_n—]_a—C—[—(CH_2)_m—OCO—R_2]_b$$

wherein a and b each represent an integer of 0 to 4, provided that a+b is 4; $R_1$ and $R_2$ each represent an organic group having 1 to 40 carbon atoms, provided that a difference in the number of carbon atoms between $R_1$ and $R_2$ is 10 or more; and n and m each represent an integer of 0 to 15, provided that n and m are not 0 at the same time.

Ester Wax General Structural Formula (2)

$$[R_1—COO—(CH_2)_n—]_a—C—[—(CH_2)_m—OH]_b$$

wherein a and b each represent an integer of 0 to 4, provided that a+b is 4; $R_1$ represents an organic group having 1 to 40 carbon atoms; and n and m each represent an integer of 0 to 15, provided that n and m are not 0 at the same time.

Ester Wax General Structural Formula (3)

$$[R_1—COO—(CH_2)_n—]_a—\overset{\overset{R_3}{|}}{C}—[(CH_2)_m—OCO—R_2]_b$$

wherein a and b each represent an integer of 0 to 3, provided that a+b is 3 or less; $R_1$ and $R_2$ each represent an organic group having 1 to 40 carbon atoms, provided that a difference in the number of carbon atoms between $R_1$ and $R_2$ is 10 or more; $R_3$ represents an organic group having 1 or more carbon atoms; and n and m each represent an integer of 0 to 15, provided that n and m are not 0 at the same time.

Specific ester waxes preferable in the present invention are shown below as structural formulas A to C of their typical compounds.

Ester Wax General Structural Formula A $$R_1—COOR_2$$

wherein $R_1$ and $R_2$ each represent a hydrocarbon group having 1 to 40 carbon atoms; and $R_1$ and $R_2$ may have the number of carbon atoms which is the same or different from each other.

Ester Wax General Structural Formula B $$R_1COO(CH_2)_nOOCR_2$$

wherein $R_1$ and $R_2$ each represent a hydrocarbon group having 1 to 40 carbon atoms; n represents an integer of 2 to 20; and $R_1$ and $R_2$ may have the number of carbon atoms which is the same or different from each other.

Ester Wax General Structural Formula C $$R_1OOC—(CH_2)_nCOOR_2$$

wherein $R_1$ and $R_2$ each represent a hydrocarbon group having 1 to 40 carbon atoms; n represents an integer of 2 to 20; and $R_1$ and $R_2$ may have the number of carbon atoms which is the same or different from each other.

The ester wax preferably used in the present invention may have a melt viscosity measured at 100° C., of form 1 to 50 mPa×sec. The melt viscosity of the ester wax is measured by, e.g., using Viscotester VT500, manufactured by HAAKE Co. If the wax has a melt viscosity less than 1 mPa×sec, the high-temperature anti-offset properties may be less effective. If on the other hand the wax has a melt viscosity more than 50 mPa×sec, it may exude with difficulty at the time of fixing, resulting in a lowering of low-temperature fixing performance.

As to molecular weight of the wax, the wax may preferably have a weight-average molecular weight (Mw) of from 300 to 1,500. If the wax has an Mw less than 300, it tends to be bared on the toner particle surfaces, and if it has an Mw more than 1,500, the low-temperature fixing performance may lower. In particular, those having an Mw within the range of from 400 to 1,250 are preferred. When the ratio of weight-average molecular weight to number-average molecular weight (Mw/Mn) is 1.5 or below, the wax can have a sharper maximum peak of the DSC endothermic curve, so that the mechanical strength of the toner particles at room temperature is improved, and especially good toner performances can be obtained, showing sharp melt characteristics at the time of fixing.

The molecular weights of the wax are measured by GPC under conditions shown below.

GPC Measurement Conditions

Apparatus: GPC-150C (Waters Co.)

Column: GMH-HT 30 cm, combination of two columns (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

Molecular weights are measured under conditions shown above. Molecular weights of the sample are calculated using a molecular weight calibration curve prepared from a monodisperse polystyrene standard sample. The calculated values are further calculated by converting the value in terms of polyethylene according to a conversion expression derived from the Mark-Houwink viscosity equation.

Specific examples of the wax may include the following compounds.

(1) $CH_3(CH_2)_{20}COO(CH_2)_{21}CH_3$ (2) $CH_3(CH_2)_{17}COO(CH_2)_9OOC(CH_2)_{17}CH_3$ (3) $CH_3(CH_2)_{17}OOC(CH_2)_{18}COO(CH_2)_{17}CH_3$

The wax in the present invention may preferably be a compound having an endothermic main peak value (melting point) at 55 to 120° C., and more preferably 60 to 90° C., in the DSC endothermic curve as measured according to ASTM D3418-8. In particular, it may more preferably be a wax having a tangent takeoff temperature of the DSC curve, at 40° C. or above. If the wax has an endothermic main peak at below 55° C., it may have so weak a self-cohesive power that it may constitute the insides or cores of toner particles with difficulty, and the wax may be deposited on the toner particle surfaces during the production of toner particles, tending to adversely affect developing performance in running tests. If it has a tangent takeoff temperature at below 40° C., the strength of toner particles may lower to tend to cause a lowering of developing performance in running tests. Fixed images obtained also tend to be images with a sticky feeling, because of the low melting point of the wax.

If on the other hand the wax has an endothermic main peak at above 120° C., it may exude with difficulty at the time of fixing, resulting in a lowering of the low-temperature fixing performance. When the toner particles are directly produced by polymerization, its solubility into a polymerizable monomer composition may lower, so that the wax may become deposited while the polymerizable monomer composition is granulated in the aqueous medium into droplets having the size of toner particles, to undesirably make it difficult to continue the granulation. More preferably the wax may have the peak within the range of from 60 to 90° C., and most preferably from 60 to 85° C. The wax may also preferably have sharp melting properties such that the half-width of the endothermic main peak is within 10° C., and more preferably within 5° C.

In the present invention, the wax may preferably be added in toner particles in an mount of from 5 to 30% by weight. Also, the toner used in the present invention may preferably contain the wax in an mount of from 5 to 30% by weight. When added in an amount less than 5% by weight, high-temperature anti-offset properties may be deteriorated, causing an offset phenomenon on the back-side images at the time of double-side fixing. When added in an amount more than 30% by weight, coalescence of toner particles may be caused during granulation when produced by polymerization, tending to form toner particles having a broad particle size distribution. This may allow the wax not to be sufficiently encapsulated to make developing performance, transfer performance and blocking resistance poor. Accordingly, this may also result in inferior image uniformity.

Meanwhile, as wax contained in the black toner used in the present invention, it may be the wax described above as used in the color toners, and may preferably be a wax having a DSC endothermic main peak at 60° C. to 120° C. It may also preferably be a solid wax whose endothermic sub-peak in DSC is not present at 60° C. or below. Use of a wax whose endothermic sub-peak in DSC is present at 60° C. or below tends to cause a decrease in image density and also tends to cause a lowering of storage stability of the toner.

By mixing in toner particles the wax having a DSC endothermic main peak at 60° C. to 120° C., the DSC endothermic main peak may preferably be adjusted so as to be 60° C. to 120° C. also in the DSC curve of the toner.

The wax used in the black toner according to the present invention may preferably have a ratio of weight-average molecular weight (Mw) to number-average molecular weight (Mn), (Mw/Mn), of from 1.0 to 2.0 as measured by the GPC described previously, having a very sharp molecular weight distribution.

In the present invention, the use of such a wax having a very sharp molecular weight distribution achieves good low-temperature anti-offset properties and high-temperature anti-offset properties in oilless fixing and also brings about an improvement in blocking resistance. In addition, the combination of the above binder resin with the wax having a very sharp molecular weight distribution achieves both an appropriate gloss and the anti-offset properties in oilless fixing.

The wax used in the black toner may preferably have a number-average molecular weight of from 350 to 2,000, and more preferably 400 to 1,000. This is preferred in view of the dispersibility in the binder resin, low-temperature anti-offset properties, high-temperature anti-offset properties, blocking resistance and many-sheet running performance.

The wax used in the black toner may include low-molecular weight hydrocarbon waxes comprised of carbon and hydrogen, long-chain alkyl alcohol waxes having OH groups, long-chain alkyl carboxylic acid waxes having COOH groups, and ester waxes.

The low-molecular weight hydrocarbon waxes may include petroleum waxes such as paraffin wax, microcrystalline wax and petrolatum; low-molecular weight polyolefin waxes such as low-molecular polyethylene; and polymethylene waxes such as Fischer-Tropsch wax. The petroleum waxes and low-molecular weight polyolefin waxes usually have a value of Mw/Mn of more than 2, and must be so purified as to have the value of Mw/Mn of from 1.0 to 2.0 and the DSC endothermic main peak at 60 to 120° C.

The long-chain alkyl alcohol waxes may include mixtures of long-chain alkyl alcohol waxes having 20 to 200 carbon atoms.

The long-chain alkyl carboxylic acid waxes may include mixtures of long-chain alkyl alcohol waxes having 20 to 200 carbon atoms.

The ester waxes may include waxes obtained by purifying carnauba wax, waxes obtained by purifying candelilla wax, and waxes mainly composed of an ester compound of a long-chain alkyl alcohol having 15 to 45 carbon atoms and a long-chain alkyl carboxylic acid having 15 to 45 carbon atoms.

As the wax incorporated in the black toner, low-molecular polyethylene having a sharp molecular weight distribution is particularly preferred.

In the black toner, the wax may preferably be contained in an amount of from 0.5 to 8 parts by weight, and more preferably from 1 to 8 parts by weight, based on 100 parts by weight of the binder resin. This is preferred in view of low-temperature anti-offset properties and high-temperature anti-offset properties in oilless fixing, and gloss.

In the present invention, for the purpose of controlling chargeability of the toners, a charge control agent may previously be added in toner particles.

As the charge control agent, those almost free of polymerization inhibitory action and aqueous-phase transfer properties are preferred among known agents. Positive charge control agents include Nigrosine dyes, triphenylmethane dyes, quaternary ammonium salts, guanidine derivatives, imidazole derivatives and amine compounds. Negative charge control agents include metal-containing salicylic acid copolymers, metal-containing monoazo dye compounds, urea derivatives, styrene-acrylic acid copolymers and styrene-methacrylic acid copolymers.

Any of these charge control agents may be added in an amount of from 0.1 to 10% by weight based on the weight of the binder resin or polymerizable monomers.

The toners used in the present invention contain colorants. Known colorants may be used as the colorants.

For example, black pigments may include carbon black, aniline black, non-magnetic ferrite and magnetite.

Yellow pigments may include yellow iron oxide, naples yellow, Naphthol Yellow S, Hanza Yellow G, Hanza Yellow 10G, Benzidine Yellow G, Benzidine Yellow GR, Quinoline Yellow Lake, Permanent Yellow NCG, and Tartrazine Yellow Lake.

Orange (reddish yellow) pigments may include Permanent Orange GTR, Pyrazolone Orange, Vulcan Fast Orange, Benzidine Orange G, Indanthrene Brilliant Orange RK, and Indanthrene Brilliant Orange GK.

Red pigments may include Permanent Red 4R, Lithol Red, Pyrazolone Red, Watchung Red calcium salt, Lake Red C, Lake Red D, Brilliant Carmine 6B, Brilliant Carmine 3B, Eosine Lake, Rhodamine Lake, and Alizarine Lake.

Blue pigments may include Alkali Blue Lake, Victoria Blue Lake, Phthalocyanine Blue, Metal-free Phthalocyanine Blue, Phthalocyanine Blue partial chloride, Fast Sky Blue, and Indanthrene Blue BG.

Violet pigments may include Fast Violet B, and Methyl Violet Lake.

Green pigments may include Pigment Green B, Malachite Green Lake, and Final Yellow Green G.

White pigments may include zinc white, titanium oxide, antimony white, and zinc sulfide.

Any of these pigments may be used alone, in the form of a mixture, or in the state of a solid solution.

The colorants used in the present invention are selected taking account of hue angle, chroma, brightness, weatherability, OHP transparency and dispersibility in toner particles. The colorant may usually be added in an an amount of from 1 to 20 parts by weight based on 100 parts by weight of the binder resin. In the case when a magnetic material is used as the black colorant, it may be used in an amount of from 30 to 150 parts by weight based on 100 parts by weight of the binder resin, which is different from the amount of other colorant.

In the case when the toners of the present invention are used as light-transmissive color toners, pigments of various types and various colors as shown below may be used.

For example, yellow pigments may include C.I. 10316 (Naphthol Yellow S), C.I. 11710 (Hanza Yellow 10G), C.I. 11660 (Hanza Yellow 5G), C.I. 11670 (Hanza Yellow 3G), C.I. 11680 (Hanza Yellow G), C.I. 11730 (Hanza Yellow GR), C.I. 11735 (Hanza Yellow A), C.I. 117408 (Hanza Yellow RN), C.I. 12710 (Hanza Yellow R), C.I. 12720 (Pigment Yellow L), C.I. 21090 (Benzidine Yellow), C.I. 21095 (Benzidine Yellow G), C.I. 21100 (Benzidine Yellow GR), C.I. 20040 (Permanent Yellow NCR), C.I. 21220 (Vulcan First Yellow 5) and C.I. 21135 (Vulcan First Yellow R).

Red pigments may include C.I. 12055 (Staring I), C.I. 12075 (Permanent Orange), C.I. 12175 (Lithol Fast Orange 3GL), C.I. 12305 (Permanent Orange GTR), C.I. 11725 (Hanza Yellow 3R), C.I. 21165 (Vulcan First Orange GG), C.I. 21110 (Benzidine Orange G), C.I. 12120 (Permanent Red 4R), C.I. 1270 (Para Red), C.I. 12085 (Fire Red), C.I. 12315 (Brilliant Fast Scarlet), C.I. 12310 (Permanent Red F2R), C.I. 12335 (Permanent Red F4R), C.I. 12440 (Permanent Red FRL), C.I. 12460 (Permanent Red FRLL), C.I. 12420 (Permanent Red F4RH), C.I. 12450 (Light Fast Red Toner B), C.I. 12490 (Permanent Carmine FB) and C.I. 15850 (Brilliant Carmine 6B).

Blue pigments may include C.I. 74100 (Metal-free Phthalocyanine Blue), C.I. 74160 (Phthalocyanine Blue) and C.I. 74180 (First Sky Blue).

External additives may be added in the toners used in the present invention, for the purpose of providing various properties. The external additives may preferably have a particle diameter of not more than 1/10 of the volume-average diameter of the toner particles in view of their durability when added to the toners. This particle diameter of the external additives is meant to be an average particle diameter measured using an electron microscope by observing surfaces of toner particles. As these properties-providing external additives, for example, the following may be used.

1) Fluidity-providing agents: Metal oxides such as silicon oxide, aluminum oxide and titanium oxide, carbon black, and carbon fluoride. It is preferred that they have been subjected to hydrophobic treatment.

2) Abrasives: Metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate.

3) Lubricants: Fluorine resin powders such as vinylidene fluoride and polytetrafluoroethylene, and fatty acid metal salts such as zinc stearate and calcium stearate.

4) Charge controlling particles: Metal oxides such as tin oxide, titanium oxide, zinc oxide, silicon oxide and aluminum oxide, and carbon black.

Any of these external additives may preferably be used in an amount ranging from 0.1 part to 10 parts by weight, and more preferably from 0.1 part to 5 parts by weight, based on 100 parts by weight of the toner particles. These additives may be used alone or in combination.

The toners used in the present invention may be either of polymerization toners and pulverization toners.

As polymerization processes for producing polymerization toners, preferred are processes such as suspension polymerization, emulsion polymerization, interfacial polymerization, dispersion polymerization and bulk polymerization, which are carried out in aqueous mediums. Suspension polymerization is particularly preferred.

In this suspension polymerization, droplets of a polymerizable monomer composition are formed in water, a dispersion medium having a great polarity. Hence, components having polar groups, contained in the polymerizable monomer composition, tend to be present at surface layer portions which are interfaces to aqueous phases, and non-polar components such as wax are not present at the surface layer portions, thus providing what is called a pseudo-capsular structure. Making the most of this feature of the production process, it is possible to incorporate a low-melting wax which can not be used in other processes such as pulverization.

Figure 7:
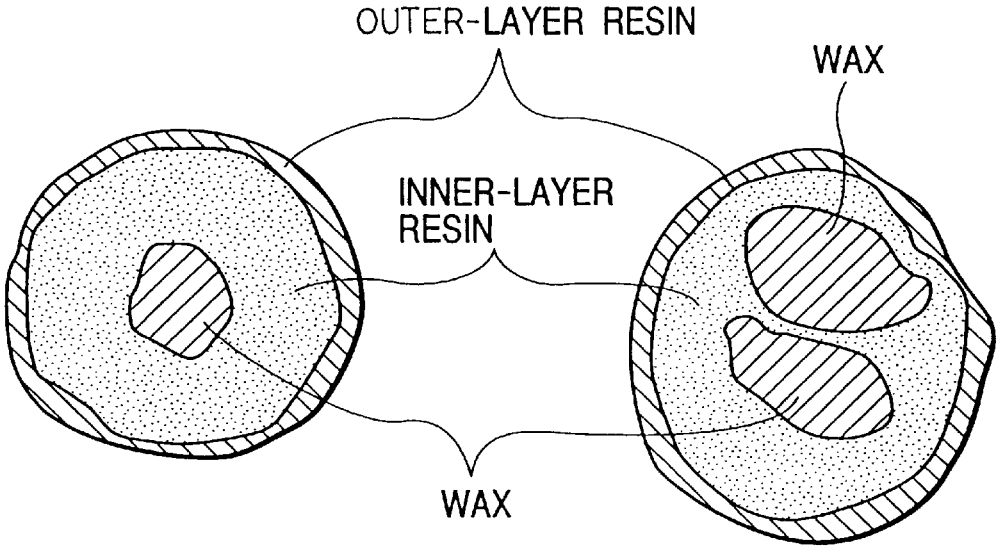
FIG. 7 schematically illustrates cross sections of particles of the toner used to form full-color images by the method of the present invention.

In the present invention, toner particles may preferably have a pseudo-capsular structure as shown in FIG. 7, consisting of an outer layer (outer-layer resin), an inner layer (inner-layer resin) and the core or inner part (in islands) formed by the wax encapsulated in toner particles.

Toners produced by suspension polymerization assume the pseudo-capsular structure wherein the wax as described above is encapsulated into toner particles, and hence can contain low-melting wax in a large quantity without damaging blocking resistance. Accordingly, a large quantity of wax melting out of toner particles when toner is heated and melted by heat or pressure at the time of fixing can be made to function effectively as a release agent, and the high-temperature offset at the time of fixing can be prevented without applying any release agent such as oil to fixing rollers. This acts advantageously also in the double-side fixing.

As a component having such polar groups, suitable is a resin having polar groups and having a glass transition point of from 55 to 80° C. and an acid value of from 1 to 35 mg KOH/g, and preferably from 5 to 35 mg KOH/g. The resin having polar groups is allowed to dissolve in the polymerizable monomer composition, and then the resulting polymerizable monomer composition is granulated in an aqueous medium into droplets with a size of toner particles. During the granulation, the resin gathers to the vicinities of surfaces of droplet particles to be formed into toner particles, and, through the subsequent step of polymerization and step of slow cooling, comes to form outer layers (shells) of toner particles in a preferable state.

If the resin having polar groups has a glass transition point below 55° C., the outer layers of toner particles may have a low strength to make toner's transfer performance and running performance poor. If on the other hand it has a glass transition point above 80° C., the outer layers may have so high a strength that the action and effect of the charge control agent present inside toner particles tend to be hindered from being exhibited on the toner particle surfaces, resulting in a lowering of charge stability of the toner and tending to cause variations of development characteristics. If the resin having polar groups has an acid value less than 1 mg KOH/g, the outer layers formed may have a low strength to cause a lowering of transfer performance and running performance. If it has an acid value more than 35 mg KOH/g, the colorant or wax tends to become deposited on the toner particle surfaces, undesirably.

The glass transition point of the binder resin is measured using DSC-7, manufactured by Perkin Elmer Co., according to ASTM D3418-8. The temperature at the detecting portion of the device is corrected on the basis of the melting points of indium and zinc, and the calorie is corrected on the basis of the heat of fusion of indium. A sample is put in a pan made of aluminum and an empty pan is set as a control, making measurement at a rate of temperature rise of 10° C./min.

The acid value of of the binder resin is measured according to JIS K-0070 in the following way.

In a 200 to 300 ml Erlenmeyer flask, 2 to 10 g of a resin sample is weighed and put, followed by addition of about 50 ml of a 1:2 mixed solvent of ethanol and benzene to dissolve the resin. If it can not be well dissolved, acetone may be added in a small quantity. Using a phenolphthalein indicator, titration is made with a N/10 potassium hydroxide-ethanol solution previously standardized, and the acid value is calculated from the consumption of the solution according to the following expression.

$$\text{Acid value (mg KOH/g)} = \text{KOH (ml)} \times N \times 56.1/\text{sample weight}$$

wherein N represents a factor of N/10 KOH.

The resin having polar groups may preferably be added in an amount ranging from 1 to 20 parts by weight, and more preferably from 2.5 to 15 parts by weight, based on 100 parts by weight of the binder resin in toner. If it is in an amount less than 1 part by weight, the function as the outer layers of toner particles may lower, and, in an amount more than 20 parts by weight, the outer layers formed in the toner particles may be excess to tend to cause a lowering of charge stability of the toner.

Among resins having polar groups, polyester resin or derivatives thereof are preferred. A typical polyester resin has compositions as shown below.

As an alcohol component of the polyester resin, it may include ethylene glycol, propylene glycol, butanediol, diethylene glycol, triethylene glycol, pentanediol, hexanediol, neopentyl glycol, hydrogenated bisphenol A, a bisphenol derivative represented by the following Formula (I);

(I)

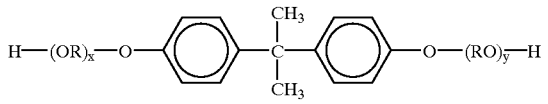

wherein R represents an ethylene group or a propylene group, x and y are each an integer of 1 or more, and an average value of x+y is 2 to 10;

and a diol represented by the following Formula (II).

(II)

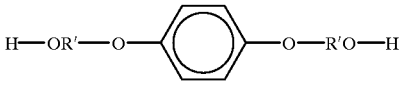

wherein R' represents —$CH_2CH_2$—,

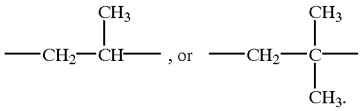

As a dibasic carboxylic acid component occupying at least 50 mole % of the total acid component, it may include benzene dicarboxylic acids and anhydrides thereof, such as phthalic acid, terephthalic acid, isophthalic acid and phthalic anhydride; and alkyldicarboxylic acids such as succinic acid, adipic acid, sebacic acid and azelaic acid, and anhydrides thereof. It may also include polyhydric alcohols such as glycerol, pentaerythritol, sorbitol, sorbitan, and oxyalkylene ethers of novolak type phenolic resin; and polycarboxylic acids such as trimellitic acid, pyromellitic acid, benzophenonetetracarboxylic acid and anhydrides thereof.

A particularly preferred alcohol component of the polyester resin is the bisphenol derivative represented by the above Formula (I). The acid component may include phthalic acid, terephthalic acid, isophthalic acid, trimellitic acid and anhydrides thereof.

The polymerizable monomer usable in forming toner particles by polymerization may include vinyl type polymerizable monomers, as exemplified by styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic acid esters; vinyl esters such as vinyl acetate, vinyl propionate, vinyl butyrate, vinyl benzoate, and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The inner layers of toner particles are constituted of a vinyl polymer formed of any of these vinyl type polymerizable monomers. Of these vinyl type polymerizable monomers, styrene polymers, styrene-acrylic copolymers or styrene-methacrylic copolymers are preferred in order to efficiently cover the wax that forms the inner part or the core.

In particular, among these polymers, polymers or copolymers having a glass transition point of above 50° C. to below 100° C. are preferred. Those having a glass transition point of 50° C. or below may make the toner have a high adhesion to fixing means such as fixing rollers, so that the transfer medium holding toner images thereon may be hard to separate from the fixing means, tending to cause a problem of fixing roller being wound around. In addition, the whole toner particles may have a low strength to tend to cause a lowering of transfer performance and developing performance in a many-sheet running test. There may also arise such a problem that, when the resulting fixed images are kept put upon one another for a long time, the images stick to each other because of such a low glass transition point. On the other hand, those having a glass transition point of 100° C. or above tend to cause a problem of faulty fixing.

Of these polymers or copolymers, those having a main peak in the region of molecular weight of from 10,000 to 50,000 in gel permeation chromatography (GPC) are advantageous for encapsulating the wax at the inner part or core in a large quantity. If the polymer or copolymer constituting the inner layers has a molecular weight main peak at less than 10,000, the polymer or copolymer may have so weak a mutual action between molecular chains that it can not well cover the wax constituting the inner part or core, tending to cause a lowering of developing performance that is ascribable to the wax. If on the other hand the polymer or copolymer has a molecular weight main peak at more than 50,000, the polymer or copolymer may have so strong a mutual action between molecular chains that the wax may insufficiently exude to the toner particle surfaces at the time of heat-and-pressure fixing of toner images, tending to cause faulty fixing and low-temperature offset when fixing temperature is relatively low.

Moreover, the use of a polymer or copolymer having a main peak in the region of molecular weight of from 15,000 to 40,000 brings about very good developing performance because the toner particles can have a sufficient strength to exhibit superior triboelectric charging performance. Because of the sufficient strength of toner particles, the toner may hardly deteriorate even after running tests, so that stable transfer performance and developing performance can be maintained.

The molecular weight of the polymer or copolymer is measured by gel permeation chromatography (GPC). A specific method for the measurement by GPC may include the following method: The toner is beforehand extracted with toluene for 20 hours by means of a Soxhlet extractor, and thereafter the toluene is evaporated by means of a rotary evaporator to obtain an extract, optionally followed by addition of an organic solvent not capable of dissolving the polymer or copolymer (e.g., chloroform), washing is thoroughly carried out. Thereafter, a solution prepared by dissolving the residue in tetrahydrofuran (THF) is filtered with a solvent-resistant membrane filter with a pore diameter of 0.3 μm to obtain a sample. Molecular weight of the sample is measured using 150° C., available from Waters Co., with columns constituted of A-801, 802, 803, 804, 805, 806 and 807, available from Showa Denko K.K., connected in series, and using a calibration curve of reference polystyrene resin.

When the toner is directly produced by polymerization, a polymerization initiator is used. The polymerization initiator may include azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. Any of these polymerization initiators may be added in an amount of from 0.5 to 20% by weight based on the weight of the polymerizable monomers, and may be used alone or in combination.

In order to control the molecular weight of the binder resin of toner particles, a chain transfer agent may be added.

In the aqueous dispersion medium, a dispersion stabilizer for the particles of the polymerizable monomer composition may be added. The dispersion stabilizer may include, e.g., finer powder of inorganic compounds such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. Organic compounds may also be used, including polyvinyl alcohol, gelatin, methyl cellulose, methyl hydroxypropyl cellulose, ethyl cellulose, carboxymethyl cellulose sodium salt, polyacrylic acid and salts thereof, polymethacrylic acid and salts thereof, and starch. Any of these dispersion stabilizers may preferably be used in an amount of from 0.2 to 20 parts by weight based on 100 parts by weight of the polymerizable monomers.

Of the dispersion stabilizers, when the inorganic compounds are used, those commercially available may be used as they are. In order to obtain fine particles, however, fine particles of the inorganic compound may be formed in the dispersion medium. For example, in the case of tricalcium phosphate, an aqueous sodium phosphate solution and an aqueous calcium chloride solution may be mixed under high-speed agitation.

In order to finely dispersing the dispersion stabilizer, a surface-active agent may be used in an amount of from 0.001 to 0.1 part by weight based on 100 parts by weight of the polymerizable monomers. This is to accelerate the initial action of the above dispersion stabilizer. As specific examples thereof, named are sodium dodecylbenzenesulfate, sodium tetradecylsulfate, sodium pentadecylsulfate, sodium octylsulfate, sodium oleate, sodium laurate, sodium octylate, potassium stearate and calcium oleate.

In the present invention, in the case when the toner particles are produced by polymerization, attention must be paid to polymerization inhibitory action or aqueous-phase transfer properties inherent in the colorants. The surfaces of colorants may be subjected to hydrophobic treatment using materials free from polymerization inhibition, effecting surface modification. In particular, most dye type colorants and carbon black have the polymerization inhibitory action, hence care must be taken when used.

A preferable method for the surface treatment of the dyes may include a method in which polymerizable monomers are previously polymerized in the presence of any of these dyes. The resulting colored polymer may be added to the polymerizable monomer composition. With regard to the carbon black, besides the same treatment as the above for the dyes, it may be treated with a material capable of reacting with surface functional groups of the carbon black, as exemplified by organosiloxane.

When the toners of the present invention are used as magnetic toners, they may be incorporated with magnetic powder. As the magnetic powder, materials capable of being magnetized when placed in a magnetic field are used, which include, for example, powders of ferromagnetic metals such as iron, cobalt and nickel, and powders of magnetic iron oxides such as magnetite and ferrite.

Since the toner particles are produced by polymerization, attention must be paid to polymerization inhibitory action or aqueous-phase transfer properties inherent in the magnetic materials. If necessary, the surfaces of magnetic materials may preferably beforehand be subjected to surface modification (e.g., hydrophobic treatment using materials free from polymerization inhibition).

In the course of the production of toner particles, the temperature may be raised at the latter half of the polymerization reaction, and also the aqueous medium may be removed in part at the latter half of the reaction or after the reaction has been completed, in order to remove unreacted polymerizable monomers, by-products and so forth that may cause a smell when toner images are fixed. After the reaction has been completed, the toner particles formed are collected by washing and filtration, followed by drying.

In the suspension polymerization, water may preferably be used as the dispersion medium in an amount of from 300 to 3,000 parts by weight based on 100 parts by weight of the polymerizable monomer composition.

In order to make more distinct the layer separation and function separation of the inner part or core, inner layer and outer layer of toner particles, the toner particles may preferably be heated for at least 60 minutes (preferably from 90 to 600 minutes) while maintaining them at a temperature higher than the DSC endothermic main peak temperature of the wax which constitutes the inner part or core, higher than the glass transition temperature of the polymer or copolymer which constitutes the inner layer, and also higher than the glass transition point of the resin having polar groups which constitutes the outer layer, and then cooled slowly at a low cooling rate of 2° C. or below per minute (preferably 1.5 to 0.25° C. per minute).

In the production of toners by polymerization, it is preferable to previously measure the endothermic main peak temperature of the wax, measure the glass transition temperature of the resin having polar groups and calculate from the composition and compositional ratio of the polymerizable monomers the theoretical glass transition temperature of the polymer or copolymer to be formed.

The heating treatment may preferably be made at a temperature higher by at least 5° C. (preferably higher by 5 to 20° C.) than the endothermic main peak temperature of the wax, higher by at least 5° C. (preferably higher by 5 to 20° C.) than the glass transition temperature of the resin having polar groups which is added to the polymerizable monomer composition, and higher by at least 5° C. (preferably higher by 7.5 to 30° C.) than the theoretical glass transition point of the polymer or copolymer to be synthesized.

In order to make image quality much higher, the toners used in the present invention may each have a weight-average particle diameter (D4) of from 4 μm to 8 μm and a coefficient of variation (A) of 35% or less as calculated by the following expression. Toners having a weight-average particle diameter smaller than 4 μm are not preferable because such toners may cause fog and image non-uniformity due to faulty transfer. Toners having a weight-average particle diameter larger than 8 μm tend to melt-adhere to the surfaces of the photosensitive member and transfer medium. Toners having a coefficient of variation (A) in number distribution above 35% may make such tendency higher.

$$\text{Coefficient of variation } A=[Sn/D1]\times 100$$

wherein Sn represents a standard deviation in the number distribution of toner particles, and D1 represents a number-average particle diameter (μm) of the toner particles.

The average particle diameter and particle size distribution of the toners can be measured by various means such as Coulter counter Model TA-II or Coulter Multisizer (manufactured by Coulter Electronics, Inc.). In the present invention, they are measured with Coulter Multisizer (manufactured by Coulter Electronics, Inc.). An interface (manufactured by Nikkaki K.K.) that outputs number distribution and volume distribution and a personal computer PC9801 (manufactured by NEC) are connected. As an electrolytic solution, an aqueous solution of about 1% NaCl is prepared using first-grade sodium chloride. For example, ISOTON R-II (available from Coulter Scientific Japan Co.) may be used. Measurement is made by adding as a dispersant from 0.1 to 5 ml of a surface-active agent (preferably alkylbenzenesulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Volume and number of toner with particle diameters of 20 $\mu$m or larger are measured with the above Coulter Multisizer, using an aperture of 100 $\mu$m as its aperture, and the volume distribution and volume distribution are calculated.

Then the volume-based, weight-average particle diameter (D4) determined from the volume distribution and the number-based, number-average particle diameter (D1) determined from the number distribution are determined.

The toner produced by polymerization may preferably have an average circularity of from 0.920 to 0.995 in circularity frequency distribution of the toner as measured with a flow type particle image analyzer. In such a case, in combination with the preferable particle diameters of toner as described previously, the toner can be improved in developing performance and transfer performance in a well balanced state and also can greatly be improved in the matching to image forming apparatus.

More specifically, when the toner is made to have a weight-average particle diameter D4 as small as 4 to 8 $\mu$m, the reproducibility is improved in the development of contour portions of images, in particular, character images and line patterns. Also, when the toner is made to have an average circularity of from 0.920 to 0.995, preferably from 0.950 to 0.995, and more preferably from 0.970 to 0.990 in its circularity frequency distribution, the toner having a small particle diameter can greatly be improved in transfer performance, which has ever been difficult to do so, and also can greatly be improved in the developability for low-potential latent images. Such tendencies are very effectively appear especially when minute spot latent images of a digital type are developed or when toner images are transferred many times through the intermediate transfer member to form a full-color image, also bringing about the good matching to image forming apparatus.

In the toners used in the present invention, it is also possible to arbitrarily control the circularity standard deviation of circularity frequency distribution of the toner. The circularity standard deviation may be controlled to be less than 0.040, preferably less than 0.035, and more preferably from 0.015 to less than 0.035. This can bring about a great improvement of properties relating to developing performance.

When a toner having an average circularity less than 0.950 in its circularity frequency distribution is in a content of 20% by number or less, the development efficiency in image formation is brought to a satisfactory level and also image formation can be satisfactorily effected.

The circularity and its frequency distribution referred to in the present invention are used as a simple method for expressing the shape of toner quantitatively. In the present invention, they are measured with a flow type particle image analyzer FPIA-1000, manufactured by Toa Iyou Denshi K.K., and the average circularity is calculated according to the following expression.

Circularity = (Circumferential length of a circle with the same area as particle projected area)/(Circumferential length of particle projected image)

Here, the "particle projected area" means the area of a binary-coded toner particle image, and the "circumferential length of particle projected image" is defined to be the length of a contour line formed by connecting edge points of the toner particle image.

The circularity referred to in the present invention is an index showing the degree of surface unevenness of toner particles. It is indicated as 1.000 when the toner particles are perfectly spherical. The more complicated the surface shape is, the smaller the value of circularity is.

Average circularity $\bar{c}$ which means an average value of circularity frequency distribution and circularity distribution SDc are calculated from the following expression where the circularity at a partition point i of particle size distribution (a central value) is represented by ci, and the frequency by $f_{ci}$.

$$\text{Average circularity } \bar{c} = \sum_{i=1}^{m} (ci \times f_{ci}) \Big/ \sum_{i=1}^{m} (f_{ci})$$

$$\text{Circularity standard deviation } SDc = \left\{ \sum_{i=1}^{m} (\bar{c} - ci)^2 \Big/ \sum_{i=1}^{m-1} (f_{ci}) \right\}^{1/2}$$

In the specific measuring method, 10 ml of ion-exchanged water from which impurity solid matter has been removed is put in a container, and a surface-active agent as a dispersant, preferably alkylbenzene sulfonate, is added therein. Thereafter, 0.02 g of a measuring sample is further added therein, followed by uniform dispersion. As a means for the dispersion, an ultrasonic dispersion machine UH-50 (manufactured by SMT Co.) to which a 5 mm diameter titanium alloy tip is attached as a vibrator is used, and dispersion treatment is made for 5 minutes to prepare a dispersion for measurement. Here, the dispersion is appropriately cooled so that its temperature does not exceed 40° C.

The toner shape is measured using the above flow type particle image analyzer. Concentration of the dispersion is again so adjusted that the toner particles are in a concentration of from 3,000 to 10,000 particles/$\mu$l at the time of measurement, and 1,000 or more particles are measured. After measurement, the data obtained are used to determine circularity frequency distribution of the toner.

In the production of pulverization toners, any known methods may be used. For example, the toners used in the present invention can be produced by thoroughly mixing the binder resin, the charge control agent, and optionally the wax, the magnetic material, the colorant and other additives by means of a mixing machine such as a Henschel mixer or a ball mill, thereafter melt-kneading the mixture using a heat kneading machine such as a heat roll, a kneader or an extruder, and cooling the kneaded product to solidify, followed by pulverization and classification to obtain colored particles. Surface treatment may optionally be made. Thereafter, an inorganic fine powder is added and mixed to produce a toner. As the order of the classification and surface treatment, either may be made first. In the step of classification, a multi-division classifier utilizing the Coanda effect may preferably be used in view of production efficiency.

In order to make image quality higher, the toner may preferably have a weight-average particle diameter (D4) of from 3 to 8 μm, and more preferably from 4 to 8 μm.

Methods for making the surface treatment may include a hot bath method in which pulverization toner particles are dispersed in water followed by heating, a heat-treating method in which the toner particles are passed through hot-air stream, and a mechanical impact method in which the toner particles are treated by imparting mechanical energy. In the mechanical impact method, thermomechanical impact applied at a temperature (Tg±10° C.) around glass transition point Tg of the toner particles as treating temperature is preferred in view of prevention of agglomeration and in view of productivity. More preferably, treatment made at a temperature within the range of 5° C. plus-minus the glass transition point Tg of the toner particles is effective especially in order to lessen particle surface pores of 10 nm or larger radius, so that the inorganic fine powder can function effectively and transfer efficiency can be improved.

The binder resin used in the pulverization toners may include, e.g., homopolymers of styrene or derivatives thereof and copolymers thereof, such as polystyrene, poly-p-chlorostyrene, polyvinyltoluene, styrene-p-chlorostyrene copolymer and styrene-vinyltoluene copolymer; copolymers of styrene with acrylates, such as styrene-methyl acrylate copolymer, styrene-ethyl acrylate copolymer and styrene-n-butyl acrylate copolymer; copolymers of styrene with methacrylates, such as styrene-methyl methacrylate copolymer, styrene-ethyl methacrylate copolymer and styrene-n-butyl methacrylate copolymer; multiple copolymers of styrene with acrylates and methacrylates; styrene copolymers of styrene with other vinyl monomers, such as styrene-acrylonitrile copolymer, styrene-methyl vinyl ether copolymer, styrene-butadiene copolymer, styrene-methyl vinyl ketone copolymer, styrene-acrylonitrile-indene copolymer and styrene-maleate copolymer; polymethyl methacrylate, polybutyl methacrylate, polyvinyl acetate, polyester, polyamide, epoxy resins, polyvinyl butyral, polyacrylic acid, phenol resins, aliphatic or alicyclic hydrocarbon resins, petroleum resins, and chlorinated paraffin. Any of these may be used alone or in combination. Binder resins of toners used especially in a pressure fixing system may include low-molecular weight polyethylene, low-molecular weight polypropylene, ethylene-vinyl acetate copolymer, ethylene-acrylate copolymer, higher fatty acids, polyamide resins and polyester resins, any of which may be used alone or in combination.

Comonomers for constituting styrene copolymers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; and dicarboxylic acids having a double bond and derivatives thereof as exemplified by maleic acid, butyl maleate, methyl maleate and dimethyl maleate.

The styrene copolymers may preferably be styrene copolymers cross-linked with a cross-linking agent having THF-insoluble matter in a content of 5% by weight or less, more preferably 3% by weight or less, and most preferably 1% by weight or less.

In the case of non-magnetic pulverization toners (yellow, magenta, cyan and black toners), preferred resins are styrene-acrylate resins and polyester resins.

As the colorant therefor, the same ones as those for polymerization toners may be used. Such a colorant may be in a content of 12 parts by weight or less, and preferably from 0.5 to 9 parts by weight, based on 100 parts by weight of the binder resin.

The binder resin for magnetic pulverization toner (black toner) can be formed by, e.g., adding a monomer solution having one or more kinds of a styrene monomer, an acrylic monomer, maleic half ester, divinylbenzene and a radical polymerization initiator having a 10-hour half-temperature of 100° C. or above, which solution is added dropwise in an organic solvent to carry out solution polymerization. Here, the amount of the cross-linking agent such as divinylbenzene, the type and amount of the radical polymerization initiator, the addition rate of the monomer solution and the polymerization temperature may be controlled to form the binder resin having the prescribed molecular weight distribution and having THF-insoluble matter in a content of 5% by weight or less.

The magnetic material of the magnetic pulverization toners may include metal oxides containing element such as iron, cobalt, nickel, copper, magnesium, manganese, aluminum or silicon. In particular, those composed mainly of iron oxide such as triiron tetraoxide or γ-iron oxide are preferred. From the viewpoint of controlling charge quantity of the magnetic black toner, it may also contain silicon element, aluminum or other metal element. The magnetic material may have a BET specific surface area, as measured by nitrogen gas adsorption, of from 2 to 30 $m^2/g$, and particularly from 3 to 30 $m^2/g$. Also, a magnetic material having a Mohs hardness of from 5 to 7 is preferred.

As the particle shape of the magnetic material, octahedral, hexahedral or spherical ones are preferred as having less anisotropy, in order to improve image density. The magnetic particles may preferably have a number-average particle diameter of from 0.05 to 1.0 μm, more preferably from 0.1 to 0.6 μm, and still more preferably from 0.1 to 0.4 μm.

The magnetic material may preferably be contained in an amount of from 30 to 200 parts by weight, and more preferably from 50 to 150 parts by weight, based on 100 parts by weight of the binder resin. If it is in an amount less than 30 parts by weight, the toner, when used in a developing assembly making use of magnetic force to transport the toner, may have a low transport performance, tending to make a developer layer uneven on the developer carrying member to tend to cause uneven images. Also, a decrease in image density tends to occur which is caused by an increase in triboelectricity of the magnetic black toner. If on the other hand it is in an amount more than 200 parts by weight, the fixing performance may lower and also it may become difficult to make the gloss higher.

An example of image forming apparatus that can well carry out a full-color image forming method will be described with reference to FIG. 1. The present invention is by no means limited to this example.

In the apparatus system shown in FIG. 1, a developer having a cyan toner, a developer having a magenta toner, a developer having a yellow toner and a developer having a black toner are put into developing assemblies 44-1, 44-2, 44-3 and 44-4, respectively. Electrostatic latent images formed by exposure 43 on an photosensitive member 41 electrostatically charged are developed by a magnetic brush development system or non-magnetic one-component development system to form toner images of respective colors on the photosensitive member 41. The photosensitive member 41 is a photosensitive drum or photosensitive belt having a photoconductive insulating material layer formed of a-Se, CdS, $ZnO_2$, OPC or a-Si. The photosensitive member 41 is driven rotatively by means of a drive system (not shown) in the direction of an arrow.

As the photosensitive member 41, a photosensitive member having an amorphous silicon photosensitive layer or an organic photosensitive layer is preferably used.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate and the charge generation layer and the charge transport layer which are superposed on the substrate in this order is one of preferred examples.

As binder resins for the organic photosensitive layer, polycarbonate resins, polyester resins or acrylic resins have an especially good transfer performance and cleaning performance, and may hardly cause faulty cleaning, melt-adhesion of toner to the photosensitive member and filming of external additives.

The step of charging has a system making use of a corona charging assembly and being in non-contact with the photosensitive member 41, or a contact type system making use of a roller or the like. Either system may be used. The contact type system as shown in FIG. 1 is used preferably so as to enable efficient and uniform charging, simplify the system and make ozone less occur.

A charging roller 42 is constituted basically of a mandrel 42*b* and a conductive elastic layer 42*a* that forms the periphery of the former. The charging roller 42 is brought into pressure contact with the surface of the photosensitive member 41 and is rotated according as the photosensitive member 41 is rotated.

When the charging roller is used, the charging process may preferably be performed under conditions of a roller contact pressure of 5 to 500 g/cm, and an AC voltage of 0.5 to 5 kVpp, an AC frequency of 50 Hz to 5 kHz and a DC voltage of ±0.2 to ±1.5 kV when a voltage formed by superimposing an AC voltage on a DC voltage, and a DC voltage of from ±0.2 to ±5 kV when a DC voltage is used.

As a charging means other than the charging roller, there is a method making use of a charging blade and a method making use of a conductive brush. These contact charging means have the effect of, e.g., making high voltage unnecessary and making ozone less occur.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

The toner image on the photosensitive member 41 is transferred to an intermediate transfer member 45 to which a voltage (e.g., ±0.1 to ±5 kV) is applied. The surface of the photosensitive member 41 after transfer is cleaned by a cleaning means 49 having a cleaning blade 48.

The intermediate transfer member 45 is comprised of a pipe-like conductive mandrel 45*b* and a medium-resistance elastic material layer 45*a* formed on its periphery. The mandrel 45*b* may comprise a plastic pipe provided thereon with a conductive coating.

The medium-resistance elastic material layer 45*a* is a solid or foamed-material layer made of an elastic material such as silicone rubber, Teflon rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer member 45 is provided in contact with the bottom part of the photosensitive member 41, being axially supported in parallel to the photosensitive member 41, and is driven rotatively at the same peripheral speed as the photosensitive member 41 in the anti-clockwise direction as shown by an arrow.

The first-color toner image formed and held on the surface of the photosensitive member 41 is, while it is passed through the transfer nip portion where the photosensitive member 41 and the intermediate transfer member 45 come into contact, transferred intermediately a sequencially to the periphery of the intermediate transfer member 45 by the aid of the electric filed formed at the transfer nip portion by a transfer bias applied to the intermediate transfer member 45.

If necessary, after the toner image has been transferred to the transfer medium, the surface of the intermediate transfer member 45 may be cleaned by a cleaning means 80 which can become contact with or separate from it. When the toner is present on the intermediate transfer member 45, the cleaning means is separated from the surface of the intermediate transfer member so that the toner image is not disturbed.

A transfer means 47 is provided in contact with the bottom part of the intermediate transfer member 45, being axially supported in parallel to the intermediate transfer member 45. The transfer means 47 is, e.g., a transfer roller or a transfer belt, and is driven rotatingly at the same peripheral speed as the intermediate transfer member 45 in the clockwise direction as shown by an arrow. The transfer means may be so provided that it comes into direct contact with the intermediate transfer member, or may be so disposed that a belt or the like comes into contact with, and between, the intermediate transfer member and the transfer means.

In the case of the transfer roller, it is constituted basically of a mandrel at the center and a conductive elastic layer that forms the periphery of the former.

The intermediate transfer member and the transfer roller may be formed of commonly available materials. The elastic layer of the transfer roller may be made to have a volume resistivity set smaller than the volume resistivity of the elastic layer of the intermediate transfer member, whereby the voltage applied to the transfer roller can be lessened, good toner images can be formed on the transfer medium and also the transfer medium can be prevented from being wound around the intermediate transfer member. In particular, the elastic layer of the intermediate transfer member may preferably have a volume resistivity at least 10 times the volume resistivity of the elastic layer of the transfer roller.

The hardness of the intermediate transfer member and transfer roller is measured according to JIS K-6301. The intermediate transfer member used in the present invention may preferably be constituted of an elastic layer with a hardness in the range of from 10 to 40 degrees. As for the hardness of the transfer roller, the transfer roller may preferably have an elastic layer with a hardness higher than the hardness of the elastic layer of the intermediate transfer member and has a value of from 41 to 80 degrees, in order to prevent the transfer medium from being wound around the intermediate transfer member. If the intermediate transfer member and the transfer roller have a reverse hardness, a concave may be formed on the transfer roller side to tend to cause the transfer medium to wind around the intermediate transfer member.

As shown in FIG. 1, a transfer belt 47 is provided beneath the intermediate transfer member 45. The transfer belt 47 is stretched over two rollers provided in parallel to the axis of the intermediate transfer member 45, i.e., a bias roller 47*a* and a tension roller 47*c*, and is driven by a drive means (not shown). The transfer belt 47 is so constructed as to be movable in the directions of an arrow on the side of the bias roller 47*a* around the tension roller 47*c* so that it can become contact with or separate from the intermediate transfer member 45 upward or downward in the direction of the arrow. To the bias roller 47*a*, a desired secondary transfer bias is applied by a secondary transfer bias source 47*d*. The tension roller 47*c* is grounded.

With regard to the transfer belt 47, used in the present embodiment is a rubber belt comprising a thermosetting urethane elastomer in which carbon black has been dispersed so as to be controlled to have a thickness of about 300 $\mu$m and a volume resistivity of $10^8$ to $10^{12}$ Ω·cm (at the time of application of 1 kV) and the surface of which is further covered with a fluororubber of 20 $\mu$m thick so as to be controlled to have a volume resistivity of $10^{15}$ Ω·cm (at the time of application of 1 kV). It has the shape of a tube 80 mm long and 300 mm wide in external size.

The transfer belt 47 described above is elongated by about 5% with tension applied by the aid of the bias roller 47*a* and tension roller 47*c*.

The transfer belt 47 is rotated at a speed equal to, or different from, the peripheral speed of the intermediate transfer member 45. The transfer medium 46 is transported between the intermediate transfer member 45 and the transfer belt 47 and simultaneously a bias with a polarity reverse to that of the toner is applied to the transfer belt 47 from a transfer bias applying means, so that the toner image on the intermediate transfer member 45 is transferred to the surface side of the transfer medium 46.

A rotating member for transfer may be made of the same material as used in the charging roller. The transfer process may preferably be performed under conditions of a roller contact pressure of 5 to 500 g/cm and a DC voltage of ±0.2 to ±10 kV.

A conductive elastic layer 47$a_1$ of the bias roller 47*a* is made of, e.g., an elastic material having a volume resistivity of $10^6$ to $10^{10}$ Ω·cm, e.g., a polyurethane, or an ethylene-propylene-diene type terpolymer (EPDM), with a conductive material such as carbon dispersed therein. A bias is applied to a mandrel 47$a_2$ by a constant voltage power source. As bias conditions, a voltage of from ±0.2 to ±10 kV is preferred.

Figure 8:
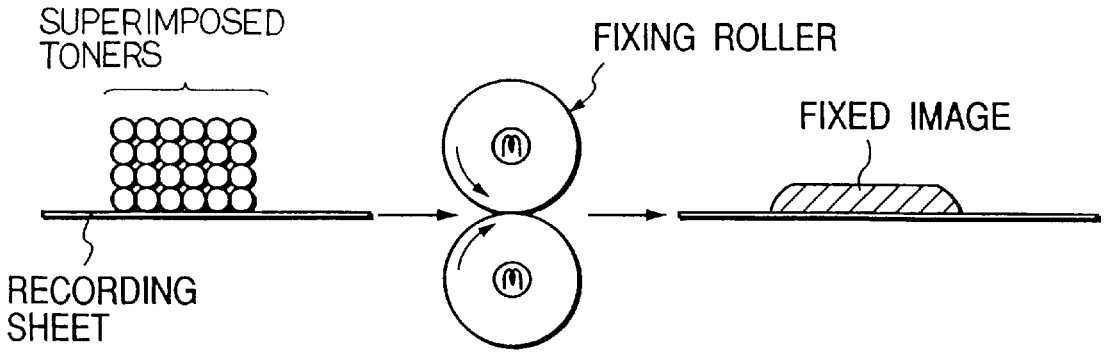
FIG. 8 schematically illustrates toners superimposed.

Subsequently, the transfer medium 46 is transported to a fixing assembly 81 constituted basically of a heat roller provided internally with a heating element such as a halogen heater and an elastic material pressure roller brought into contact therewith under pressure, and is passed between the heat roller and the pressure roller, thus the toner images superimposed are heat-and-pressure fixed to the transfer medium, as shown in FIG. 8. Another method may also be used in which the toner image is fixed by a heater through a film.

A developing method making use of a one-component developer (toner) will be described below. In the present invention, one-component developing methods such as magnetic one-component development and non-magnetic one-component development may be used. Their details will be described with reference to some drawings, but not necessarily limited to these. First, magnetic one-component development will be described with reference to FIG. 2.

Figure 2:
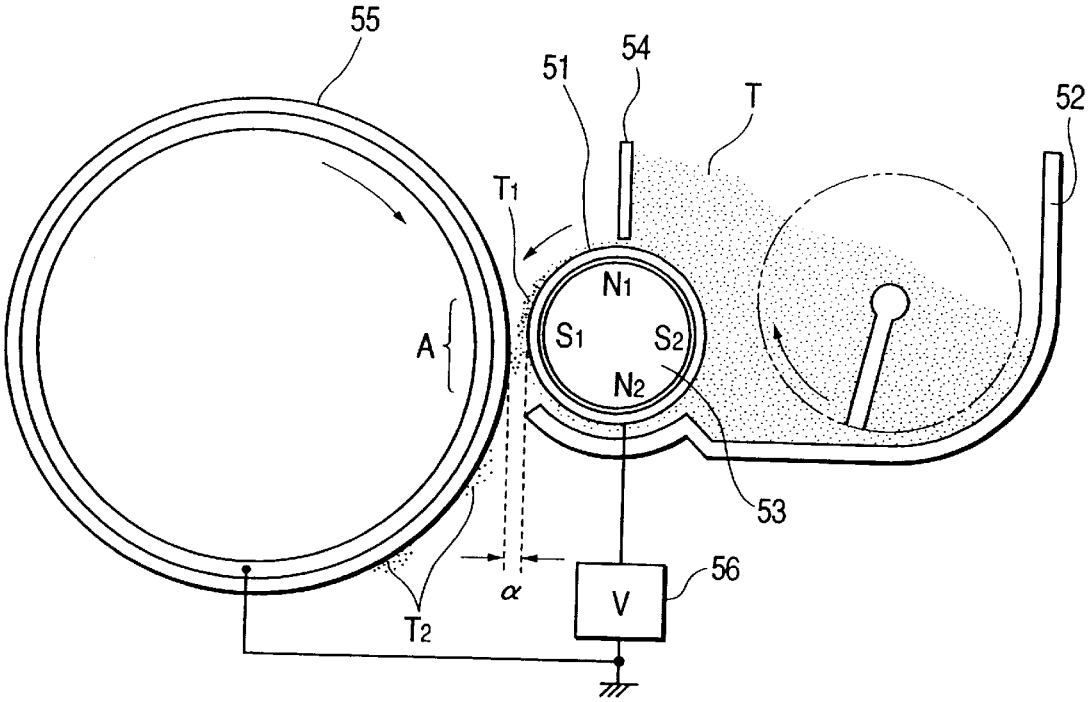
FIG. 2 schematically illustrates a developing process used in magnetic one-component development.

In FIG. 2, substantially the right-half periphery of a developing sleeve 51 always comes in contact with the toner stock inside a toner container 52. The toner in the vicinity of the surface of the developing sleeve is attracted to and carried on the surface of the developing sleeve by the action of magnetic force and/or electrostatic force, the magnetic force being produced by a magnetism generating means 53 internally provided with the developing sleeve. As the developing sleeve 51 is rotatively driven, the magnetic toner layer formed on the surface of the developing sleeve 51 passes through the position of a regulation member 54, while the toner is formed into a regulated layer as a thin-layer magnetic toner T1 with a uniform thickness at every portion. The magnetic toner is electrostatically charged chiefly by the frictional contact between the developing sleeve surface and the magnetic toner standing in the vicinity thereof in the toner stock, as the developing sleeve 51 is rotated. As the developing sleeve 51 is rotated, the thin-layer surface of the magnetic toner carried on the developing sleeve 51 is moved toward the side of a latent image bearing member 55 and is passed through a developing zone A at which the latent image bearing member 55 and the developing sleeve 51 come nearest. While passing through the developing zone A, the magnetic toner of the magnetic toner thin layer formed on the developing sleeve 51 flies by the aid of DC and AC electric fields formed by direct current and alternating current voltages applied across the latent image bearing member 55 and the developing sleeve 51 by a voltage applying means 56, and reciprocates (at a gap α) between the surface of the latent image bearing member 55 and the surface of the developing sleeve 51. Finally, the magnetic toner on the side of the developing sleeve 51 is selectively transferred and attracted to the surface of the latent image bearing member 55 in accordance with potential patterns of electrostatic latent images, so that toner images T2 are successively formed.

The surface of the developing sleeve 51, having passed through the developing zone A and from which the magnetic toner has been selectively consumed, is returned to the toner stock in the toner container (hopper) 52, so that it is again supplied with the magnetic toner and the magnetic toner thin layer T1 carried on the developing sleeve 51 is transported to the developing zone A. In this way, the step of development is repeated.

The regulation member 54 serving as a toner thin-layer forming means used in the assembly shown in FIG. 2 is a doctor blade such as a metallic blade or a magnetic blade provided at a certain distance from the developing sleeve 51. Alternatively, in place of the doctor blade, a rigid roller or sleeve formed of metal, resin or ceramic may be used, and a magnetism generating means may be provided on the inside thereof.

As the toner thin-layer forming regulation member, an elastic blade or elastic roller (not shown) may also be used which is elastically brought into contact with the surface of the developing sleeve (toner carrying member) by elastic force. In the developing method according to the present invention, a toner thin-layer coating means may particularly preferably be used in which the regulation member comes into touch with the toner carrying member under an elastic force to apply the toner into thin layer.

As the elastic blade or the elastic roller, it is possible to use rubber elastic materials such as silicone rubber, urethane rubber and NBR; synthetic resin elastic materials such as polyethylene terephthalate, or metal elastic materials such as stainless steel, steel and phosphor bronze, as well as composite materials thereof. The part coming into touch with the sleeve may preferably be made of the rubber elastic material or resin elastic material.

In instances where the elastic material and the toner carrying member are required to have a durability, resin or rubber may preferably be stuck to, or applied on, the metal elastic material so as to touch the part coming into contact with the developing sleeve.

The quality of the material for the elastic blade or elastic roller is greatly concerned in the charging of the toner. Hence, an organic or inorganic substance may be added to, may be melt-mixed in, or may be dispersed in, the elastic material. For example, the charging performance of toner can be controlled by adding metal oxide, metal powder, ceramic, carbon allotrope, whisker, inorganic fibers, dye, pigment or surface-active agent. Especially when the elastic material is a molded product of rubber or resin, a metal oxide such as silica, alumina, titania, tin oxide, zirconium oxide or zinc oxide, carbon black, and a charge control agent commonly used in toners may preferably be incorporated therein.

In the case when the toner is negatively chargeable, as quality of the rubber or resin, those positively chargeable with ease, such as urethane, polyamide, nylon and melamine may preferably be selected. In the case when the toner is positively chargeable, those negatively chargeable with ease, such as urethane resin, silicone, polyester, fluorine resin (e.g., Teflon) and polyimide may preferably be selected.

Figure 3:
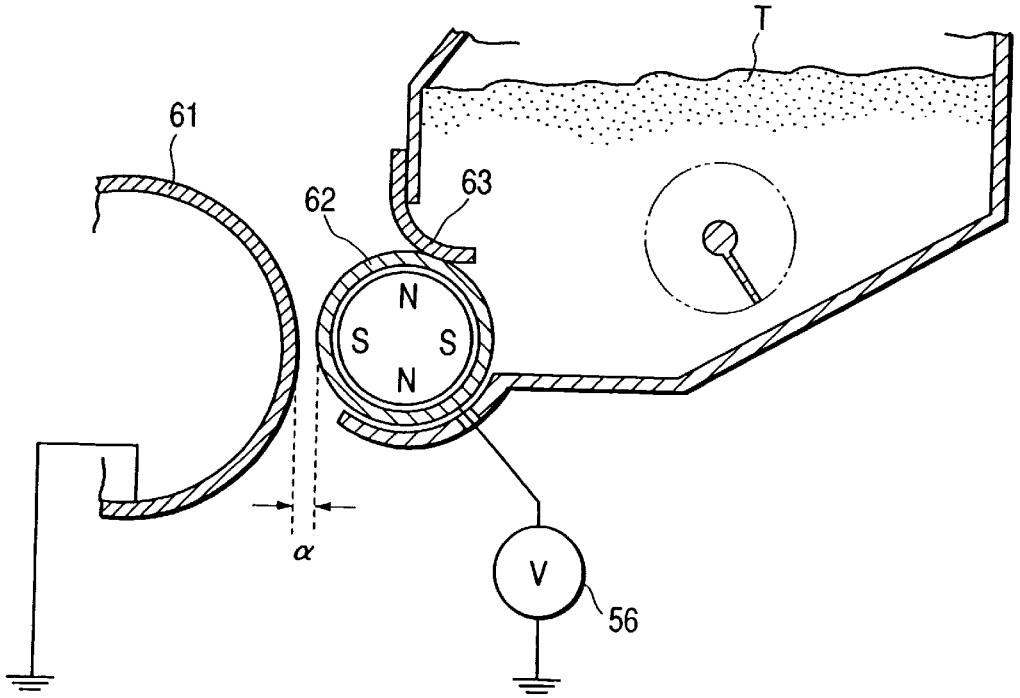
FIG. 3 schematically illustrates a developing process used in magnetic one-component development.

An example in which the elastic blade is used is shown in FIG. 3.

An elastic blade 63 is, at its upper side base portion, fixedly held on the side of a developer container and is so provided that its blade inner face side (or its outer face side in the case of the adverse direction) is, at its lower side, brought into touch with the surface of the developing sleeve 62 under an appropriate elastic pressure in such a state that it is deflected against the elasticity of the blade in the forward direction or backward direction of the rotation of the developing sleeve. According to such construction, a toner layer can be formed which is stabler and thinner even against environmental variations and is dense. The reason therefor is not necessarily clear, and it is presumed that, compared with an assembly in which a metal blade usually used is fitted at a certain distance from the sleeve, toner particles are forcibly brought into friction with the developing sleeve surface by the elastic member and hence the toner is charged always in the like state without regard to any changes in behavior caused by environmental changes of toner.

On the other hand, the toner tends to be so excessively charged that it tends to melt-adhere to the developing sleeve or elastic blade. However, the toner used in the developing method of the present invention can preferably be used because it has a superior releasability and has a stable triboelectric chargeability.

In the case of the magnetic one-component development, it is effective for the elastic blade 63 to be brought into touch with the developing sleeve 62 at a pressure of 0.1 kg/m or above, preferably from 0.3 to 25 kg/m, and more preferably from 0.5 to 12 kg/cm, as a linear pressure in the generatrix direction of the sleeve. If the touch pressure is smaller than 0.1 kg/m, it is difficult to apply the toner uniformly, resulting in a broad charge quantity distribution of the toner to cause fog or black spots around line images. If the touch pressure is greater than 25 kg/m, a great pressure is applied to the toner to cause deterioration of the toner and occurrence of agglomeration of the toner, and also a great torque is required in order to drive the developing sleeve, undesirably.

The gap $\alpha$ between a latent image bearing member 61 and the developing sleeve 62 may preferably be set to be from 50 to 500 $\mu$m. When a magnetic blade is used as the doctor blade, the gap between the doctor blade and the developing sleeve may preferably be set to be from 50 to 400 $\mu$m.

The layer thickness of the magnetic toner layer formed on the developing sleeve may preferably be made smaller than the gap $\alpha$ between the latent image bearing member and the developing sleeve. In some cases, the layer thickness of the magnetic toner layer may be regulated in such an extent that part of a large number of ears of the magnetic toner constituting the magnetic toner layer comes into contact with the surface of the latent image bearing member.

The developing sleeve is rotated at a peripheral speed of from 100 to 200% with respect to the latent image bearing member. The alternating bias voltage applied by a voltage applying means 56 may preferably be applied at a peak-to-peak voltage of 0.1 kV or above, preferably from 0.2 to 3.0 kV, and more preferably from 0.3 to 2.0 kV. The alternating bias may be applied at a frequency of from 0.5 to 5.0 kHz, preferably from 1.0 to 3.0 kHz, and more preferably from 1.5 to 3.0 kHz. As the waveform of the alternating bias, rectangular waveform, sine waveform, sawtooth waveform and triangle waveform can be used. An asymmetrical AC bias having different time for which forward/backward voltages are applied may also be used. It is also preferable to superimpose a DC bias.

In the present invention, the developing sleeve is formed using a material such as metal and ceramic, and aluminum or SUS stainless steel is preferred in view of chargeability to the toner. The developing sleeve may be formed using a pipe member merely drawn or cut. However, in order to control toner transport performance and triboelectricity-providing performance, the drawn or cut pipe member is polished, surface-roughened in the peripheral direction or longitudinal direction, blast-finished or coated. In the present invention, it is preferable to apply blast finishing, where shaped particles or amorphous particles are used as a blasting agent, and any of these may be used alone or in combination. Lap-treated members may also be used.

As the amorphous or shapeless particles, any abrasive grains may be used.

As the shaped particles, usable are various rigid body spheres comprised of a metal such as stainless steel, aluminum, steel, nickel or brass, or various rigid body spheres such as ceramic, plastic or glass beads. The shaped particles may preferably be spherical or rotary ellipsoidal particles having substantially curved surfaces and a major axis/minor axis ratio of from 1 to 2 (preferably from 1 to 1.5, and more preferably from 1 to 1.2). Accordingly, the shaped particles used for the blasting of the developing sleeve surface may preferably be those having a diameter (or length) of from 20 to 250 $\mu$m). When lap-treated, shaped blasting particles may preferably be larger than shapeless blasting particles, and may particularly preferably from 1 to 20 times, and more preferably from 1.5 to 9 times, the latter.

When lap-treated with the shaped particles, at least one of treating time and treating particle impact force may preferably be made less than that of blasting with shapeless particles.

The developing sleeve may also preferably be a sleeve on the surface of which a coat layer containing conductive fine particles is formed. The conductive fine particles may preferably be fine carbon particles, crystalline graphite, or a mixture of fine carbon particles and crystalline graphite.

The crystalline graphite used in the present invention is roughly grouped into natural graphite and artificial graphite. The artificial graphite is obtained in the following way: Pitch coke is solidified with tar pitch and put into a graphitizing furnace after calcination at about 200° C., followed by treatment at a high temperature of about 2,300° C., thus crystals of carbon grow to turn into graphite. The natural graphite is yielded from the ground as a product completely graphitized by undergoing the subterranean heat and underground high pressure over a very long period of time. Since these graphites have various excellent properties, they are widely used in an industrial scale. Graphite is a very soft and lubricative crystal mineral having dark-gray or black gloss, and is used in pencils and so forth. Besides, since it has heat resistance and chemical stability, it is utilized in lubricants, fire-resistant materials, electric materials and so forth in the form of powder, solid or coating materials. Some has crystal structure belonging to the hexagonal system and besides the rhombic system, and has a perfect laminar structure. With regard to electrical properties, free electrons are present between carbon-carbon bonds to form a good conductor of electricity. The graphite used in the present invention may be either of the natural graphite and the artificial graphite.

The graphite used in the present invention may preferably have a particle diameter of from 0.5 $\mu$m to 10 $\mu$m.

As polymeric materials used to form the coat layer, usable are, e.g., thermoplastic resins such as styrene resins, vinyl resins, polyether sulfone resin, polycarbonate resin, polyphenylene oxide resin, polyamide resin, fluorine resin, cellulose resins and acrylic resins; and thermosetting resins or photocurable resins such as epoxy resin, polyester resin, alkyd resin, phenol resin, melamine resin, polyurethane resin, urea resin, silicone resin and polyimide resin. In particular, those having releasability such as silicone resin and fluorine resin or those having superior mechanical properties such as polyether sulfone, polycarbonate, polyphenylene oxide, polyamide, phenol resin, polyester, polyurethane or styrene resins are more preferred.

Conductive amorphous carbon is commonly defined as "an aggregate of crystallites produced by subjecting hydrocarbons or carbon-containing compounds to combustion or thermal decomposition in an insufficiently air-supplied state". It has come into wide use especially because it has superior electrical conductivity, can be incorporated into polymeric materials to impart conductivity thereto and can attain any desired electrical conductance to a certain extent by controlling its amount when added. Conductive amorphous carbon used in the present invention may preferably be those having a particle diameter of from 10 $\mu$m to 80 $\mu$m, and more preferably from 15 $\mu$m to 40 $\mu$m.

Figure 4:
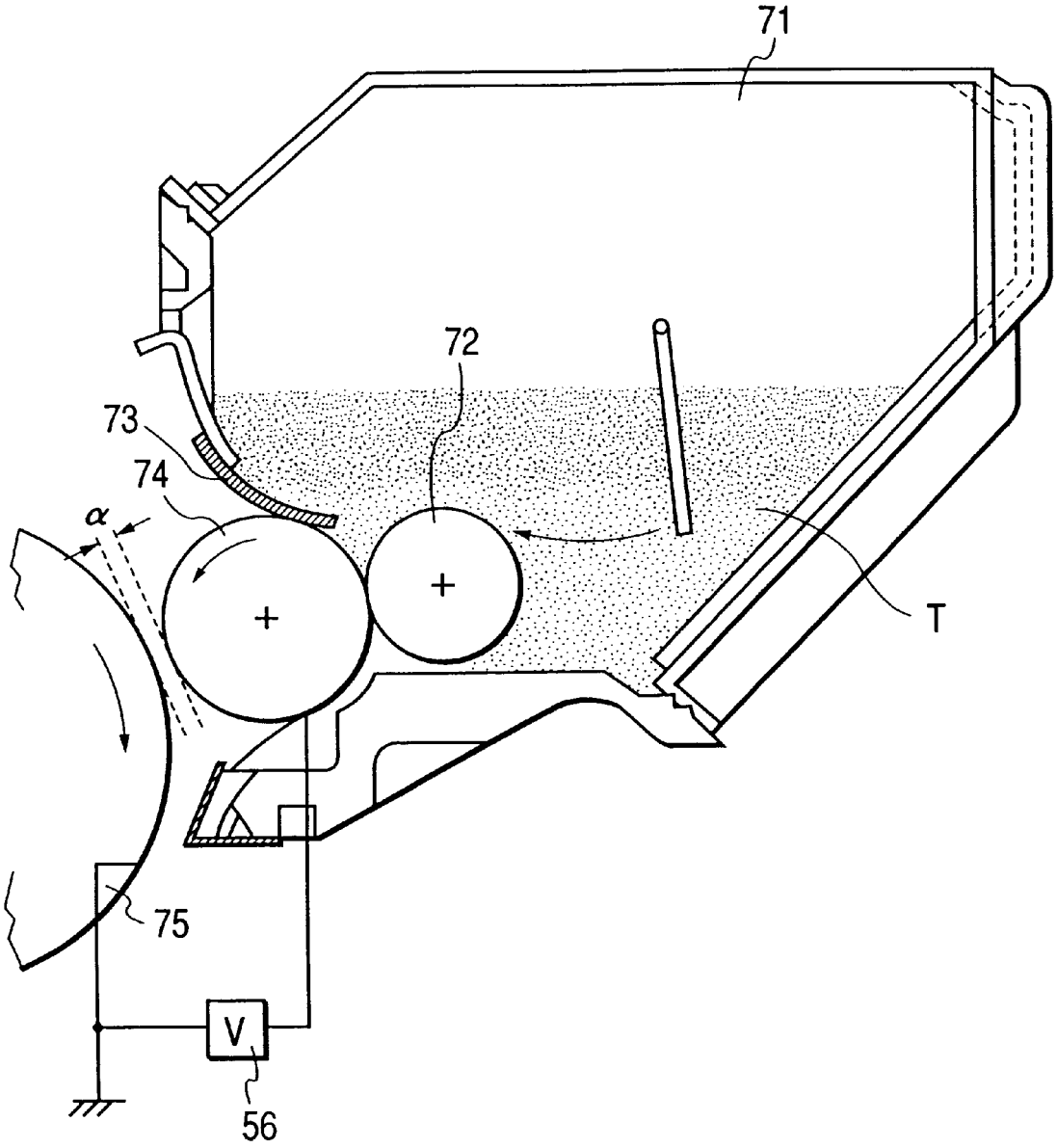
FIG. 4 schematically illustrates a developing process used in non-magnetic one-component development.

An example of developing methods used when non-magnetic one-component development is performed will be described below. The example is not necessarily limited thereto. FIG. 4 shows an apparatus for developing an electrostatic latent image formed on a latent image bearing member. Reference numeral 75 denotes the latent image bearing member, on which latent images are formed by an electrophotographic processing means or electrostatic recording means (not shown). Reference numeral 74 denotes a developing sleeve, which is comprised of a non-magnetic sleeve made of aluminum or stainless steel.

The developing sleeve may be prepared using a crude pipe of aluminum or stainless as it is, and may preferably be prepared by spraying glass beads on it to uniformly rough the surface, by mirror-finishing its surface or by coating its surface with a resin. It corresponds to the one used in the magnetic one-component development.

Toner T is reserved in a hopper 71, and is fed onto the developing sleeve (toner carrying member) by a feed member 72. As the feed member 72, a feed roller may preferably be used which is comprised of a porous elastic material, e.g., a foamed material such as polyurethane foam. It is rotated at a relative speed that is not zero in the forward direction or backward direction with respect to the developing sleeve so that the toner can be fed onto the developing sleeve and also the developer remaining on the developing sleeve after development (the toner not participating in development) can be stripped. Here, the width at which the feed roller comes into contact with the developing sleeve (i.e., nip width) may preferably be from 2.0 to 10.0 mm, and more preferably from 4.0 to 6.0 mm, taking account of the balance of the feeding and stripping of toner. While on the other hand the toner inevitably undergoes stress in excess to tend to cause an increase in agglomeration due to toner deterioration or cause melt-adhesion or sticking of toner to the developing sleeve, feed roller and so forth, the toner used in the developing method of the present invention has superior fluidity and releasability and also has running stability, and hence can preferably be used also in the developing method having such a feed member. As the feed member, a brush member comprised of resin fiber such as nylon or Rayon fiber may also be used. Such a feed member is very effective in the one-component development making use of non-magnetic developers (toners) which can not utilize magnetic binding force, but may also be used in the magnetic one-component development making use of magnetic one-component developers (toners).

The toner fed onto the developing sleeve is applied in a thin layer and uniformly by means of a regulating member 73. Such a toner thin-layer forming regulating member corresponds to the one used in the magnetic one-component development described previously. Particularly preferred is a method in which the toner is applied by an elastic blade or an elastic roller under pressure contact with the surface of the developing sleeve (toner carrying member). As the elastic blade or elastic roller, it is preferable to use those made of a material of triboelectric series, suitable for electrostatically charging the toner to the desired polarity. It corresponds to the one used in the magnetic one-component development. In the present invention, silicone rubber, urethane rubber or styrene-butadiene rubber is preferred. An organic resin layer may also be provided which is formed of polyamide, polyimide, nylon, melamine, melamine cross-linked nylon, phenol resin, fluorine resin, silicone resin, polyester resin, urethane resin, styrene resin or acrylic resin. A conductive rubber or conductive resin may also be used, and a filler such as metal oxide, carbon black, inorganic whisker or inorganic fiber and a charge control agent may be further dispersed in the rubber or resin of the elastic blade. This is preferable because appropriate conductivity and charge-providing properties can be imparted to the blade and the toner can appropriately be charged.

It is effective for the elastic blade or elastic roller to be brought into touch with the developing sleeve at a pressure of from 0.1 to 25 kg/m, and preferably from 0.5 to 12 kg/cm, as a linear pressure in the generatrix direction of the developing sleeve. Correspondingly to the case of the magnetic one-component development, the adjustment of touch pressure to 0.1 to 25 kg/m makes it possible to effectively loosen the agglomeration of toner and makes it possible to effect instantaneous rise of the charge quantity of the toner.

In the system where the toner is applied in a thin-layer on the developing sleeve by the blade as proposed in the present invention, especially in the non-magnetic one-component development, the developing sleeve is rotated at a peripheral speed of from 100 to 300% with respect to the latent image bearing member in order to attain a sufficient image density. It may preferably be rotated at a peripheral speed of from 120 to 250%. At a peripheral speed less than 100%, the sufficient image density may be hard to attain when developing performance is lowered as a result of repeated development. At a peripheral speed more than 300%, the toner tends to deteriorate and the sleeve and blade also tend to deteriorate (e.g., scrape and contamination), resulting in a lowering of developing performance to make it hard to attain a sufficient image density or cause uneven development. It is also preferable to make the thickness of the toner layer on the developing sleeve smaller than the gap length where the developing sleeve faces the latent image bearing member, and to apply an alternating electric field to this gap. More specifically, an alternating electric field or a development bias formed by superimposing a DC electric field to an alternating electric field may be applied across the developing sleeve 74 and the latent image bearing member 75 through a bias applying means 56, whereby the toner can be moved easily from the developing sleeve surface to the latent image bearing member surface and images with a much better quality can be formed. These conditions also correspond to those for the magnetic one-component development.

A DC electric field and/or an AC electric field may still also be applied (not shown) to the developing blade as a regulating member and the feed roller or brush member as a feed member, whereby, on account of a loosening action to the toner, uniform thin-layer coating performance and uniform charging performance are improved at the regulating portion on the developing sleeve, and the feeding/stripping of the toner can be made more smoothly at the feeding portion, making it possible to achieve a sufficient image density and form good-quality images.

Figure 5:
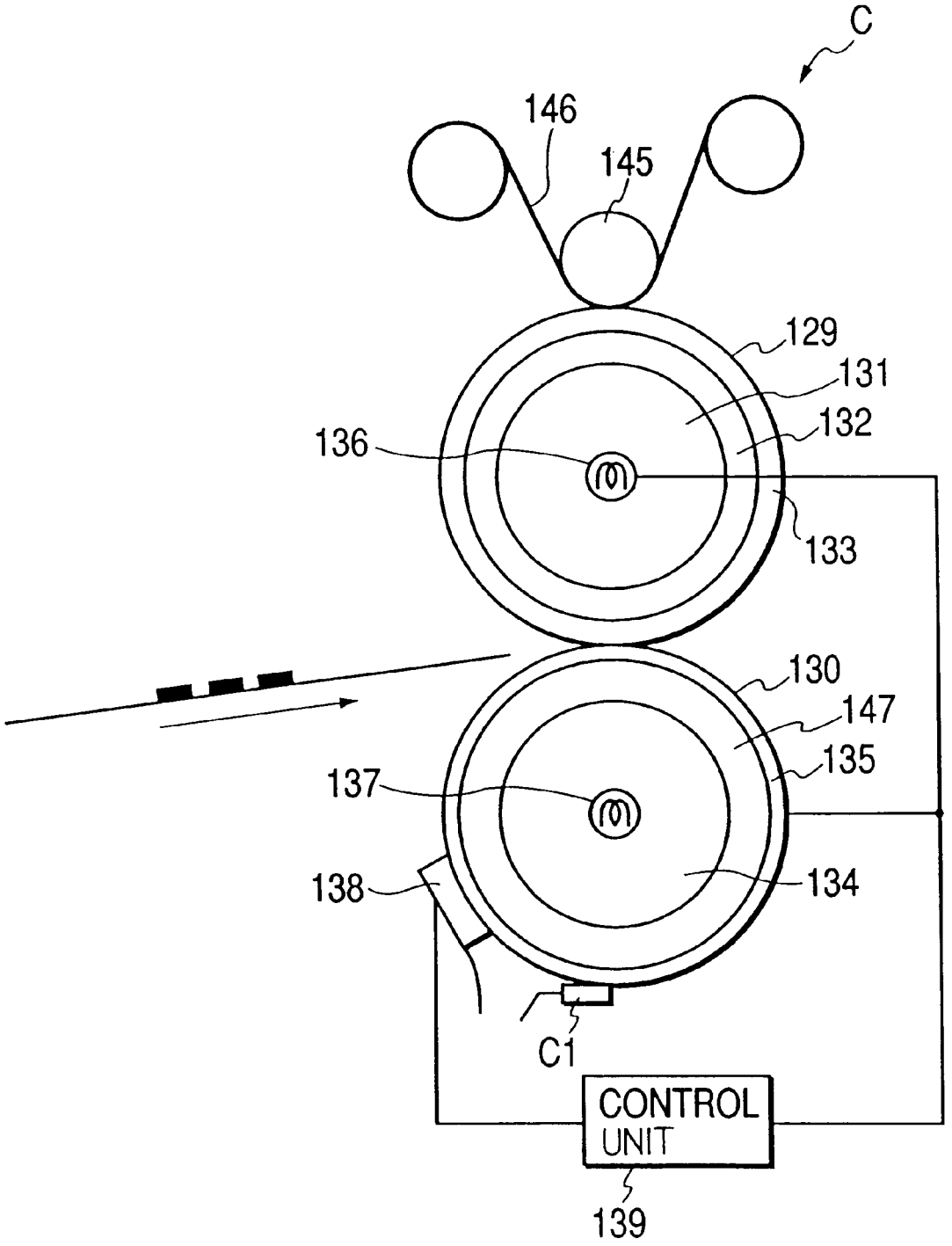
FIG. 5 schematically illustrates a fixing assembly which can make double-side fixing.

FIG. 5 shows the constitution of an oilless fixing assembly which enables the double-side fixing in the present invention.

In FIG. 5, a fixing roller 129 as a fixing means comprises, e.g., a mandrel 131 made of aluminum and provided thereon an HTV (high-temperature vulcanizing) silicone rubber layer 132 and, on the outer surface thereof, an RTV (room-temperature vulcanizing) silicone rubber layer 133, and is formed to be 3 mm in thickness and 60 mm in diameter.

A pressure means pressure roller 130 comprises, e.g., a mandrel 134 made of aluminum and provided thereon an HTV silicone rubber layer 147 and, on the outer surface thereof, an RTV silicone rubber layer 135, and has a diameter of 60 mm.

The fixing roller 129 is provided with a heat-generating means halogen heater 136 and the pressure roller 130 is similarly provided with a heater 137 so that the heat can be applied on the both sides. The temperature of the pressure roller is detected by a thermistor 138 brought into contact with the pressure roller 130. In accordance with the temperature thus detected, the halogen heaters 136 and 37 are controlled by a control unit 139, and the temperature of the fixing roller 129 and the temperature of the pressure roller 130 is so controlled as to be kept at about 170° C. The fixing roller 129 and the pressure roller 130 are pressed against each other at a total pressure of about 40 kg by means of a pressing mechanism (not shown).

A cleaning assembly C has a nonwoven fabric web 146 comprised of NORMEX (available from Du Pont), which is pressed against the fixing roller 129 by a pressing roller 145 to perform cleaning. The web 146 is appropriately wound up by a wind-up unit (not shown) so that any toner does not deposit on the contact area.

A method of forming full-color images by electrophotography without providing an intermediate transfer member will be described below with reference to FIG. 6.

Figure 6:
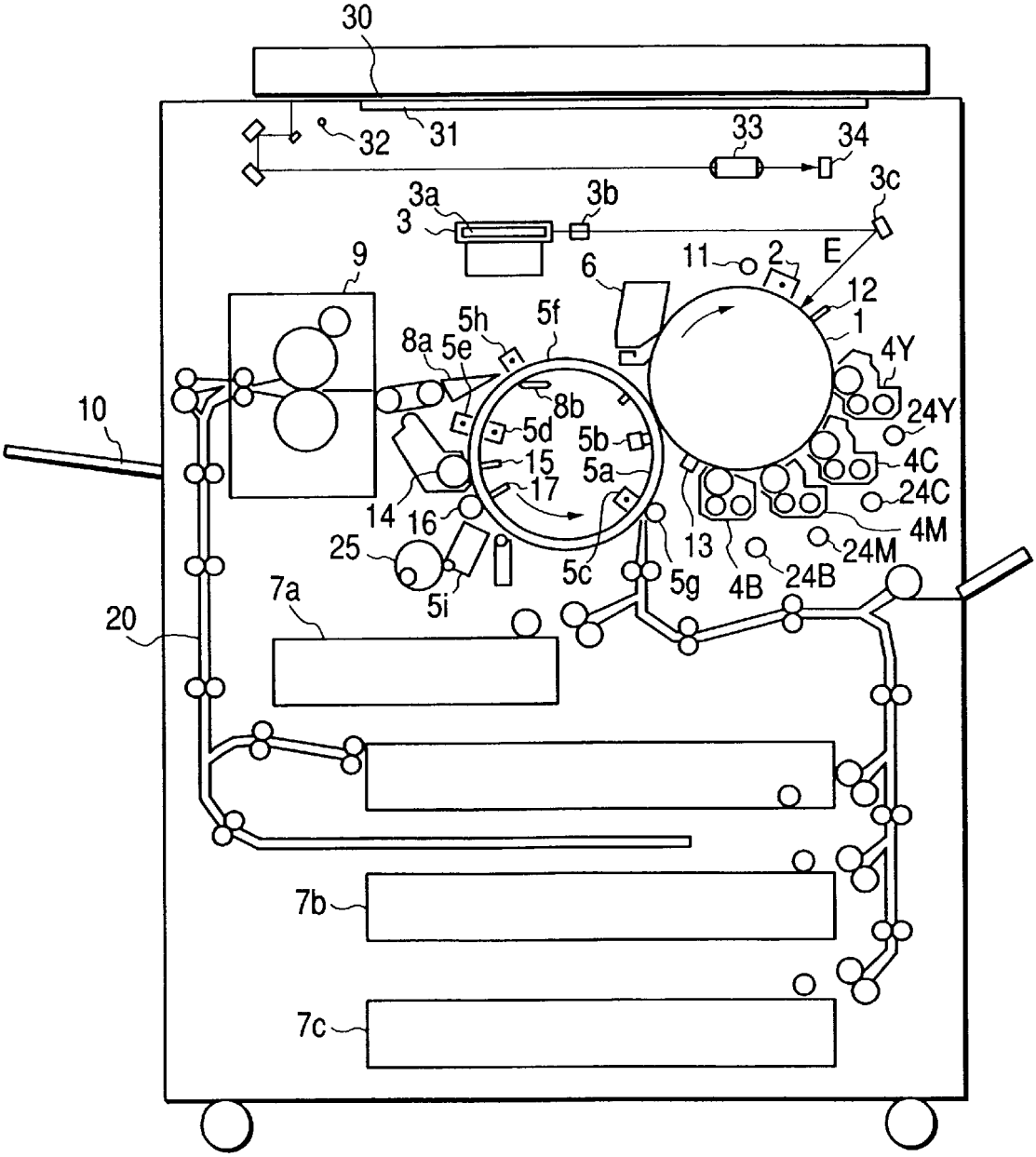
FIG. 6 schematically illustrates an image forming apparatus making use of no intermediate transfer member.

FIG. 6 schematically illustrates the constitution of an example of an image forming apparatus for forming full-color images by electrophotography. The image forming apparatus shown in FIG. 6 is used as a full-color copying machine or a full-color printer. In the case of the full-color copying machine, it has, as shown in FIG. 6, a digital color-image reader section at the top and a digital color-image printer section at a lower part.

In the image reader section, an original 30 is placed on an original-setting glass 31, and an exposure lamp 32 is put into exposure scanning, whereby an optical image reflected from the original 30 is focused on a full-color sensor 34 through a lens 33 to obtain color separation image signals. The color separation image signals are processed by a video processing unit (not shown) through an amplifying circuit (not shown), and then forwarded to the digital color-image printer section.

In the image printer section, a photosensitive drum 1 as an image bearing member has a photosensitive layer having, e.g., an organic photoconductor, and is supported rotatably in the direction of an arrow. Around the photosensitive drum 1, a pre-exposure lamp 11, a corona charging assembly 2, a laser exposure optical system 3, a potential sensor 12, four different color developing assemblies 4Y, 4C, 4M and 4B, a detecting means 13 for detecting the quantity of light on the drum, a transfer member 5 and a cleaner 6 are provided.

In the laser exposure optical system, the image signals sent from the reader section are converted into optical signals for image scanning exposure, and the laser light thus converted is reflected on a polygonal mirror 3*a* and projected on the surface of the photosensitive drum 1 through a lens 3*b* and a mirror 3*c*.

In the printer section, the photosensitive drum 1 is rotated in the direction of the arrow at the time of image formation. The photosensitive drum 1 is, after decharged by the pre-exposure lamp 11, uniformly negatively charged by means of the charging assembly 2, and then irradiated with an optical image E for each separated color to form an electrostatic image on the photosensitive drum 1.

Next, a stated developing assembly is operated to develop the electrostatic image formed on the photosensitive drum 1 to form a toner image on the photosensitive drum 1 by the use of a toner. The developing assemblies 4Y, 4C, 4M and 4B sequentially come close to the photosensitive drum 1 in accordance with the respective separated colors by the operation of eccentric cams 24Y, 24C, 24M and 24B, respectively, to perform development.

The transfer assembly has a transfer drum 5*a*, a transfer charging assembly 5*b*, an attraction charging assembly 5*c* for electrostatically attracting a transfer medium serving as the recording sheet, and an attraction roller 5*g* provided opposite to the assembly 5*c*, an inside charging assembly 5*d*, an outside charging assembly 5*e* and a separation charging assembly 5*h*. The transfer drum 5*a* is supported on a shaft so that it can be rotatively driven, and has a transfer sheet 5*f* serving as a transfer medium holding member that holds the transfer medium at an open zone on the periphery thereof, the transfer sheet being provided on a cylinder under integral adjustment. As the transfer sheet 5*f*, a resin film such as polycarbonate film is used.

The transfer medium is transported from a cassette 7*a*, 7*b* or 7*c* to the transfer drum 5*a* through a transfer sheet transport system, and is held on the transfer drum 5*a*. With the rotation of the transfer drum 5*a*, the transfer medium held on the transfer drum 5*a* is repeatedly transported to the transfer position facing the photosensitive drum 1. While passing through the transfer position, the toner image formed on the photosensitive drum 1 is transferred to the transfer medium by the action of the transfer charging assembly 5*b*.

The above steps of image formation are repeatedly carried out on yellow (Y), magenta (M), cyan (C) and black (B), thus a color image formed by superimposing four color toner images is obtained on the transfer medium held on the transfer drum 5*a*.

The transfer medium to which the four color toner images have been thus transferred is separated from the transfer drum 5*a* by the action of a separation claw 8*a*, a separation push-up roller 8*b* and the separation charging assembly 5*h*, and sent to a heat-and-pressure fixing assembly 9, where the toner images are fixed by heating and pressing and thereby the color mixing of the toners, color formation, and fixing to the transfer medium are carried out until a full-color fixed image is formed. Thereafter, the transfer medium having the image thus formed is outputted to a tray 10. Thus, the formation of a full-color image is completed. Meanwhile, the photosensitive drum 1 is cleaned by the cleaner 6 so that toners remaining on its surface are removed, and thereafter again put to the steps of image formation. As a cleaning member, a blade may be used, or a fur brush or a nonwoven fabric, or a combination of any of these may be used.

Around the transfer drum 5*a*, an electrode roller 14 and a fur brush 15 which are provided opposite to each other with intervention of the transfer sheet 5*f*, an oil removing roller 16 and a back-up brush 17 are provided to perform cleaning in order to remove any powder adhering to the surface of the transfer sheet 5*f* on the transfer drum 5*a* and any oil adhering to the surface of the transfer sheet 5*f*. Such cleaning is performed before or after the image formation, and at any time jamming has occurred, i.e., paper has blocked.

An eccentric cam 25 is operated at desired timing to actuate a cam follower 5*i* associated with the transfer drum 5*a*, whereby the gap between the transfer sheet 5*f* and the photosensitive drum 1 can be set as desired. For example, during a stand-by or at the time of power-off, a space can be kept between the transfer drum 5*a* and the photosensitive drum 1.

Full-color images are formed using the image forming apparatus described above. In the above image forming apparatus, monochromatic fixed images or multi-color fixed images can be formed by selecting either a monochromatic mode or a multi-color mode.

EXAMPLES

The present invention will be described below in greater detail by giving Examples. The present invention is by no means limited by these Examples.

Example 1

| | |
|---|---|
| Styrene monomer | 170 parts |
| n-Butyl acrylate monomer | 30 parts |
| Disazo yellow pigment (C.I. Pigment Yellow 13) | 14 parts |
| Linear polyester resin (polycondensation product of polyoxypropylene type bisphenol A with phthalic acid; acid value: 11 mg KOH/g) | 16 parts |
| Aluminum compound of dialkysalicylic acid | 2 parts |
| Divinylbenzene | 0.3 part |
| Ester wax produced from alkylcarboxylic acid having 22 carbon atoms and alkyl alcohol having 22 carbon atoms (DSC endothermic main peak value: 75° C.) | 40 parts |
| | (all by weight) |

A mixture of the above materials was dispersed for 5 hours by means of an attritor, and thereafter 3 parts by weight of a polymerization initiator lauroyl peroxide was added to obtain a polymerizable monomer composition, which was then introduced into an aqueous solution prepared by mixing 1,200 parts by weight of water and 7 parts by weight of tricalcium phosphate. Thereafter, the resultant composition was stirred by means of a TK-type homomixer at 10,000 rpm to carry out granulation for 13 minutes. Thereafter, the high-speed stirrer was changed to a stirrer having propeller stirring blades, and the polymerization was continued for 10 hours at 100 rpm. After the polymerization was completed, diluted hydrochloric acid was added to dissolve away the calcium phosphate, further followed by washing and drying to obtain non-magnetic yellow toner particles having a weight-average particle diameter of 6.6 μm. Cross sections of the yellow toner particles were observed to find that they had a structure wherein the wax was covered with shell resin as shown in Table 7.

100 parts by weight of the above yellow toner particles and 1.5 parts by weight of hydrophobic fine silica particles were mixed using a Henschel mixer to obtain a yellow toner.

A cyan toner was obtained in the same manner as the above production process except that the disazo yellow pigment in the above formulation was replaced with a cyan pigment phthalocyanine pigment and the amount of the divinylbenzene was change from 0.3 part by weight to 0.4 part by weight.

A magenta toner was also obtained in the same manner as the above yellow toner production process except that the disazo yellow pigment was replaced with a magenta pigment quinacridone pigment and the amount of the divinylbenzene was change from 0.3 part by weight to 0.5 part by weight.

Then, a monomer solution comprised of;

| | |
|---|---|
| styrene monomer | 150 parts |
| n-butyl acrylate monomer | 40 parts |
| mono-n-butyl maleate | 10 parts |
| divinylbenzene | 1.0 part |
| di-tert-butyl peroxide | 2.5 parts |
| | (all by weight) |

was added dropwise in a container holding xylene (having a condenser to reflux xylene) over a period of 3 hours. After its addition was completed, solution polymerization was carried out for 8 hours, followed by distillation under reduced pressure to remove xylene, thus binder resin No. 1 was obtained.

Subsequently;

| | |
|---|---|
| the resin No. 1 | 100 parts |
| iron compound of monoazo dye | 2.5 parts |
| polyethylene wax | 4 parts |
| magnetic iron oxide (average particle diameter: 0.25 μm; saturation magnetization and residual magnetization under 10 K oersteds: 60 emu/g and 10 emu/g, respectively; coercive force: 120 oersteds) | 100 parts |
| | (all by weight) |

were mixed by means of a blender, and the mixture obtained was melt-kneaded using an extruder heated to a temperature of 110° C., the melt-kneaded product obtained was cooled, the cooled product obtained was crushed using a hammer mill, the crushed product obtained was pulverized using a mechanical pulverizer (Turbo Mill, manufactured by Turbo Kogyo K.K.), and the pulverized product obtained was classified using a multi-division classifier utilizing the Coanda effect (elbow-jet classifier), thus a magnetic black toner having a weight-average particle diameter of 6.9 μm was obtained.

With regard to the yellow toner, cyan toner, magenta toner and black toner thus obtained, the content of THF-insoluble matter, the number-average particle diameter (Mn) of THF-soluble matter, the ratio of weight-average particle diameter (Mw) to number-average particle diameter (Mn) (Mw/Mn) and the content of cross-linking agent unit per 100 parts by weight of binder resin in toner were measured to obtain the results shown in Table 1.

The content of cross-linking agent unit per 100 parts by weight of binder resin in toner was determined in the following way.

First, samples having different cross-linking agent quantities are prepared and a calibration curve is obtained by GC-MS. Subsequently, the toner is put to GC-MS and the content of cross-linking agent unit is determined from the calibration curve. The measurement by GC-MS is not particularly restricted, and may be made using, e.g., Curie Point Pyrolyzer (manufactured by Japan Analytical Industry Co., Ltd.).

With regard to the yellow toner, cyan toner, magenta toner and black toner obtained, the weight-average particle diameter, the coefficient of variation thereof, the average circularity, the circularity standard deviation and the content of toner particles with an average circularity less than 0.950 were also measured to obtain the results shown in Table 2.

Using a modified machine of an image forming apparatus CLC700 (manufactured by CANON INC.), constituted as shown in FIG. 1, images were continuously formed on 100 sheets in environment of normal temperature/normal humidity (25° C./60% RH) and environment of low temperature/low humidity (15° C./10% RH). In this image formation, development and transfer were so made that toners are in the order of yellow toner, cyan toner, magenta toner and black toner from the side of recording sheet transfer paper (A4-size paper of 105 g/m$^2$ in basis weight), and color toner images transferred onto the transfer paper were fixed by means of the fixing assembly shown in FIG. 5 to form a full-color image. In the step of development, the black toner was put in the developing assembly shown in FIG. 3 to make development by magnetic one-component jumping development, and the yellow toner, cyan toner and magenta toner were each put in the developing assembly shown in FIG. 4 to make development by non-magnetic one-component jumping development.

The full-color images thus formed were images having a good dot reproduction and an excellent color reproduction.

Using the above image forming apparatus, images were also formed by double-side copying. As a result, good images were formed without occurrence of any paper jam.

Full-color images thus formed were evaluated on the following items.

(1) Blistering

Images formed at the initial stage and on the 100th sheet in the environment of low temperature/low humidity were evaluated according to the following evaluation criteria by examining any blistering within the area of 3 cm×3 cm at the middle portion of the images.

A: No blistering occurs.

B: Blistering smaller than 2 mm diameter occurs at less than 5 spots.

C: Blistering smaller than 2 mm diameter occurs at 5 spots or more, or blistering of 2 mm or larger diameter occurs.

(2) Blank Areas

In image reproduction in the environment of low temperature/low humidity, images formed on the 100th sheet were evaluated by visual observation according to the following evaluation criteria by examining any blank areas having appeared in a rubbing test made. The rubbing test was made by rubbing the images five times with Silbon paper "Lens Cleaning Paper DESPER R" (available from Ozu Paper Co., Ltd.) under application of a load of 50 g/cm$^2$.

A: No blank area appears.

B: After rubbing, blank areas appear to an extent it is not so conspicuous.

C: Blank areas due to low-temperature offset occur before rubbing, or blank areas appear seriously after rubbing.

(3) Paper Curl

On A3-size paper of 80 g/m$^2$ in basis weight, images were continuously reproduced on 100 sheets in the environment of normal temperature/normal humidity (25° C./60% RH) to make evaluation on paper curl. Paper with images at the initial stage and on the 100th sheet was put on a flat place, and the height at the most curled portion among the four corners of the paper was measured to make evaluation on the paper curl.

A: Curl is less than 1 cm.

B: Curl is 1 cm or more to less than 2.5 cm.

C: Curl is 2.5 cm or more to less than 5.0 cm.

D: Curl is 5.0 cm or more.

Results of the evaluation on the above items are shown in Table 3.

Example 2

A yellow toner, a cyan toner, a magenta toner and a black toner were produced in the same manner as in Example 1 except that the black toner was produced by suspension polymerization in the manner as described above, using a polymerizable monomer composition comprised of the following.

| | |
|---|---|
| Styrene monomer | 170 parts |
| n-Butyl acrylate monomer | 30 parts |
| Graphitized carbon | 13 parts |
| Linear polyester resin (polycondensation product of polyoxypropylene type bisphenol A with phthalic acid; acid value: 11 mg KOH/g) | 15 parts |
| Aluminum compound of dialkysalicylic acid) | 2 parts |
| Divinylbenzene | 1 part |
| Paraffin wax (DSC endothermic main peak value: 70° C.) | 10 parts |
| | (all by weight) |

Using these toners, full-color fixed images were formed, and evaluation was made in the same manner as the above. Incidentally, the development using the black toner was made using the developing assembly shown in FIG. 4.

Physical properties of each toner obtained are shown in Tables 1 and 2, and the results of evaluation in FIG. 3.

Example 3

A yellow toner, a cyan toner, a magenta toner and a black toner were produced in the same manner as in Example 1 except that the cross-linking agent was changed to ethylene glycol acrylate. Evaluation was made in the same manner as in Example 1.

Physical properties of each toner obtained are shown in Tables 1 and 2, and the results of evaluation in FIG. 3.

Example 4

A yellow toner, a cyan toner, a magenta toner and a black toner were produced in the same manner as in Example 1 except that the amount of divinylbenzene in the yellow toner was changed to 0.02 part by weight, the amount of divinylbenzene in the cyan toner to 0.04 part by weight, the amount of divinylbenzene in the magenta toner to 0.06 part by weight, and the amount of divinylbenzene in the black toner to 0.10 part by weight. Evaluation was made in the same manner as in Example 1.

Physical properties of each toner obtained are shown in Tables 1 and 2, and the results of evaluation in FIG. 3.

Example 5

A yellow toner, a cyan toner, a magenta toner and a black toner were produced in the same manner as in Example 1 except that the black toner obtained therein was subjected to spherical treatment. The spherical treatment of the black toner was made at 1,600 rpm for 2 minutes, using a surface-modifying apparatus of the type the mechanical impact is applied by rotating a rotor.

Using these toners, full-color fixed images were formed, and evaluation was made in the same manner as the above. Incidentally, the development using the black toner was made using the developing assembly shown in FIG. 4.

Physical properties of each toner obtained are shown in Tables 1 and 2, and the results of evaluation in FIG. 3.

Comparative Example 1

A yellow toner, a cyan toner, a magenta toner and a black toner were produced in the same manner as in Example 1 except that the cross-linking agent in each formulation of the four color toners was changed to ethylene glycol dimethacrylate, and the amount of the cross-linking agent added in the yellow toner was changed to 0.5 part by weight, the amount of the cross-linking agent added in the cyan toner to 0.45 part by weight, the amount of the cross-linking agent added in the magenta toner to 0.25 part by weight, and the amount of the cross-linking agent added in the black toner to 0.1 part by weight. Evaluation was made in the same manner as in Example 1.

Physical properties of each toner obtained are shown in Tables 1 and 2, and the results of evaluation in FIG. 3.

Comparative Example 2

A yellow toner, a cyan toner, a magenta toner and a black toner were produced in the same manner as in Example 2 except that the cross-linking agent in each formulation of the four color toners was changed to ethylene glycol dimethacrylate, and the amount of the cross-linking agent added in the yellow toner was changed to 0.5 part by weight, the amount of the cross-linking agent added in the cyan toner to 0.45 part by weight, the amount of the cross-linking agent added in the magenta toner to 0.25 part by weight, and the amount of the cross-linking agent added in the black toner to 0.1 part by weight.

Using these toners, full-color fixed images were formed, and evaluation was made in the same manner as in Example 1. Incidentally, the development using the black toner was made using the developing assembly shown in FIG. 4.

Physical properties of each toner obtained are shown in Tables 1 and 2, and the results of evaluation in FIG. 3.

Comparative Example 3

A yellow toner, a cyan toner, a magenta toner and a black toner were produced in the same manner as in Example 1 except that the amount of the cross-linking agent added in the yellow toner was changed to 3.0 parts by weight, the amount of the cross-linking agent added in the cyan toner to 2.5 parts by weight, the amount of the cross-linking agent added in the magenta toner to 2.4 parts by weight, and the amount of the cross-linking agent added in the black toner to 0.1 part by weight. Evaluation was made in the same manner as in Example 1.

Physical properties of each toner obtained are shown in Tables 1 and 2, and the results of evaluation in FIG. 3.

Comparative Example 4

As yellow toner formulation, prepared was a monomer composition comprised of;

| | |
|---|---|
| styrene monomer | 170 parts |
| n-butyl acrylate monomer | 30 parts |
| disazo yellow pigment (C.I. Pigment Yellow 13) | 15 parts |
| linear polyester resin (polycondensation product of polyoxypropylene type bisphenol A with phthalic acid; acid value: 11 mg KOH/g) | 15 parts |
| aluminum compound of dialkylsalicylic acid) | 2 parts |
| divinylbenzene | 0.5 part |
| ester wax produced from alkylcarboxylic acid having 22 carbon atoms and alkyl alcohol having 22 carbon atoms (DSC endothermic main peak value: 75° C.) | 35 parts |
| | (all by weight) |

In the case of a cyan toner, the above disazo yellow pigment was replaced with a phthalocyanine pigment. In the case of a magenta toner, the above disazo yellow pigment was replaced with a quinacridone pigment.

As black toner formulation, also prepared was a monomer composition comprised of;

| | |
|---|---|
| styrene monomer | 170 parts |
| n-butyl acrylate monomer | 30 parts |
| graphitized carbon | 15 parts |
| linear polyester resin (polycondensation product of polyoxypropylene type bisphenol A with phthalic acid; acid value: 11 mg KOH/g) | 15 parts |
| aluminum compound of dialkylsalicylic acid) | 2 parts |
| divinylbenzene | 0.5 part |
| paraffin wax (DSC endothermic main peak value: 70° C.) | 35 parts |
| | (all by weight) |

Using the above monomer compositions, four color toners were produced by the suspension polymerization which was the process for producing the yellow toner in Example 1.

Using these toners, full-color fixed images were formed in the same manner as in Example 1, and evaluation was made in the same manner. Incidentally, the development using the black toner was made using the developing assembly shown in FIG. 4.

Physical properties of each toner obtained are shown in Tables 1 and 2, and the results of evaluation in FIG. 3.

Example 6

Full-color images were formed in the same manner as in Example 1 except that images were formed using a modified machine of an image forming apparatus CLC900 (manufactured by CANON INC.), constituted as shown in FIG. 6. Evaluation was made in the same manner as in Example 1.

The full-color images thus formed were images having a good dot reproduction and an excellent color reproduction.

Using the above image forming apparatus, images were also formed by double-side copying. As a result, good images were formed without occurrence of any paper jam.

The results of evaluation are shown in Table 4.

Examples 7 to 10 &

Comparative Examples 5 to 8

Full-color images were formed in the same manner as in Examples 2 to 5 and Comparative Examples 1 to 4, respectively, except that images were formed using a modified machine of an image forming apparatus CLC900 (manufactured by CANON INC.), constituted as shown in FIG. 6. Evaluation was made in the same manner as in Example 1.

The results of evaluation are shown in Table 4.

TABLE 1

| | THF-insoluble matter | THF-soluble matter | | Content of cross-linking agent unit in toner |
|---|---|---|---|---|
| | (wt. %) | Mn | Mw/Mn | (wt. %) |
| Example 1: | | | | |
| Yellow toner | 30 | 7,500 | 35 | 0.150 |
| Cyan toner | 36 | 5,500 | 34 | 0.200 |
| Magenta toner | 41 | 6,500 | 27 | 0.240 |
| Black toner | 1 | 14,000 | 11 | 0.480 |
| Example 2: | | | | |
| Yellow toner | 31 | 7,450 | 35 | 0.150 |
| Cyan toner | 37 | 5,450 | 34 | 0.200 |
| Magenta toner | 42 | 6,450 | 27 | 0.240 |
| Black toner | 60 | 9,000 | 30 | 0.490 |
| Example 3: | | | | |
| Yellow toner | 31 | 7,600 | 34 | 0.140 |
| Cyan toner | 36 | 5,600 | 33 | 0.190 |
| Magenta toner | 42 | 6,600 | 26 | 0.230 |
| Black toner | 1 | 14,000 | 11 | 0.480 |
| Example 4: | | | | |
| Yellow toner | 1 | 4,500 | 20 | 0.005 |
| Cyan toner | 2 | 4,300 | 18 | 0.015 |
| Magenta toner | 3 | 4,400 | 16 | 0.028 |
| Black toner | 1 | 6,000 | 9 | 0.047 |
| Example 5: | | | | |
| Yellow toner | 30 | 7,500 | 35 | 0.150 |
| Cyan toner | 36 | 5,500 | 34 | 0.200 |
| Magenta toner | 41 | 6,500 | 27 | 0.240 |
| Black toner | 1 | 14,000 | 11 | 0.480 |
| Comparative Example 1: | | | | |
| Yellow toner | 40 | 6,500 | 26 | 0.240 |
| Cyan toner | 35 | 5,400 | 33 | 0.220 |
| Magenta toner | 25 | 7,700 | 36 | 0 120 |
| Black toner | 1 | 14,000 | 11 | 0.480 |
| Comparative Example 2: | | | | |
| Yellow toner | 41 | 6,450 | 26 | 0.245 |
| Cyan toner | 36 | 5,550 | 33 | 0.220 |
| Magenta toner | 27 | 7,600 | 35 | 0.120 |
| Black toner | 61 | 9,000 | 30 | 0.040 |
| Comparative Example 3: | | | | |
| Yellow toner | 80 | 3,000 | 45 | 1.400 |
| Cyan toner | 76 | 3,300 | 43 | 1.200 |
| Magenta toner | 74 | 3,300 | 42 | 1.150 |
| Black toner | 1 | 14,000 | 11 | 0.480 |
| Comparative Example 4: | | | | |
| Yellow toner | 43 | 6,000 | 27 | 0.240 |
| Cyan toner | 44 | 6,100 | 27 | 0.240 |
| Magenta toner | 43 | 6,000 | 27 | 0.240 |
| Black toner | 45 | 6,300 | 26 | 0.240 |

TABLE 2

| | Weight-average particle diameter (μm) | Coefficient of variation | Average circularity | Circularity standard deviation | Toner particles with average circularity less than 0.950 (% by number) |
|---|---|---|---|---|---|
| Example 1: | | | | | |
| Yellow toner | 7.0 | 30 | 0.971 | 0.034 | 18 |
| Cyan toner | 7.0 | 31 | 0.970 | 0.034 | 17 |
| Magenta toner | 7.0 | 31 | 0.970 | 0.034 | 16 |
| Black toner | 6.9 | 34 | 0.950 | 0.041 | 36 |
| Example 2: | | | | | |
| Yellow toner | 7.0 | 30 | 0.971 | 0.034 | 18 |
| Cyan toner | 7.0 | 31 | 0.970 | 0.034 | 17 |
| Magenta toner | 7.0 | 31 | 0.970 | 0.034 | 16 |
| Black toner | 7.2 | 31 | 0.972 | 0.033 | 18 |
| Example 3: | | | | | |
| Yellow toner | 7.1 | 30 | 0.970 | 0.034 | 19 |
| Cyan toner | 7.1 | 31 | 0.971 | 0.034 | 17 |
| Magenta toner | 7.0 | 31 | 0.972 | 0.034 | 16 |
| Black toner | 6.9 | 34 | 0.949 | 0.041 | 36 |
| Example 4: | | | | | |
| Yellow toner | 7.1 | 30 | 0.970 | 0.034 | 18 |
| Cyan toner | 7.2 | 30 | 0.971 | 0.033 | 17 |
| Magenta toner | 7.3 | 30 | 0.971 | 0.034 | 16 |
| Black toner | 7.3 | 34 | 0.949 | 0.041 | 36 |
| Example 5: | | | | | |
| Yellow toner | 7.0 | 30 | 0.971 | 0.034 | 18 |
| Cyan toner | 7.0 | 31 | 0.970 | 0.034 | 17 |
| Magenta toner | 7.0 | 31 | 0.970 | 0.034 | 16 |
| Black toner | 6.9 | 34 | 0.955 | 0.033 | 33 |
| Comparative Example 1: | | | | | |
| Yellow toner | 7.2 | 30 | 0.972 | 0.034 | 19 |
| Cyan toner | 7.2 | 31 | 0.971 | 0.034 | 18 |
| Magenta toner | 7.1 | 30 | 0.970 | 0.034 | 17 |
| Black toner | 6.9 | 34 | 0.948 | 0.040 | 36 |
| Comparative Example 2: | | | | | |
| Yellow toner | 7.2 | 30 | 0.972 | 0.033 | 19 |
| Cyan toner | 7.2 | 30 | 0.972 | 0.034 | 18 |
| Magenta toner | 7.2 | 30 | 0.971 | 0.034 | 17 |
| Black toner | 7.1 | 30 | 0.970 | 0.034 | 16 |
| Comparative Example 3: | | | | | |
| Yellow toner | 7.3 | 31 | 0.971 | 0.033 | 18 |
| Cyan toner | 7.3 | 30 | 0.970 | 0.033 | 18 |
| Magenta toner | 7.4 | 31 | 0.969 | 0.033 | 17 |
| Black toner | 6.9 | 34 | 0.949 | 0.040 | 36 |
| Comparative Example 4: | | | | | |
| Yellow toner | 7.3 | 30 | 0.970 | 0.034 | 17 |
| Cyan toner | 7.3 | 31 | 0.971 | 0.034 | 17 |
| Magenta toner | 7.3 | 30 | 0.969 | 0.034 | 16 |
| Black toner | 7.3 | 30 | 0.970 | 0.034 | 17 |

TABLE 3

| | Image reproduction | | | | |
|---|---|---|---|---|---|
| | Initial stage | | 100th sheet | | |
| | Blistering | Paper curl | Blistering | Blank areas | Paper curl |
| Example: | | | | | |
| 1 | A | A | A | B | B |
| 2 | A | A | A | A | B |
| 3 | A | A | A | B | B |

TABLE 3-continued

| | Image reproduction | | | | |
|---|---|---|---|---|---|
| | Initial stage | | 100th sheet | | |
| | Blistering | Paper curl | Blistering | Blank areas | Paper curl |
| 4 | A | B | A | B | B |
| 5 | A | A | A | A | B |

TABLE 3-continued

| | Image reproduction | | | | |
|---|---|---|---|---|---|
| | Initial stage | | 100th sheet | | |
| | Blistering | Paper curl | Blistering | Blank areas | Paper curl |
| Comparative Example: | | | | | |
| 1 | B | D | C | D | D |
| 2 | B | D | C | C | D |
| 3 | C | D | C | D | D |
| 4 | B | C | B | B | C |

TABLE 4

| | Image reproduction | | | | |
|---|---|---|---|---|---|
| | Initial stage | | 100th sheet | | |
| | Blistering | Paper curl | Blistering | Blank areas | Paper curl |
| Example: | | | | | |
| 6 | A | A | A | B | B |
| 7 | A | A | A | A | B |
| 8 | A | A | A | B | B |
| 9 | A | B | A | B | B |
| 10 | A | A | A | A | B |
| Comparative Example: | | | | | |
| 5 | B | D | C | D | D |
| 6 | B | D | C | C | D |
| 7 | C | D | C | D | D |
| 8 | B | C | B | B | C |

What is claimed is:

1. An image forming method comprising:

forming a first electrostatic latent image on a latent image bearing member, developing the first electrostatic latent image by the use of a first toner to form a first toner image on the latent image bearing member and transferring the first toner image to an intermediate transfer member;

forming a second electrostatic latent image on the latent image bearing member, developing the second electrostatic latent image by the use of a second toner to form a second toner image on the latent image bearing member and transferring the second toner image to the intermediate transfer member;

forming a third electrostatic latent image on the latent image bearing member, developing the third electrostatic latent image by the use of a third toner to form a third toner image on the latent image bearing member and transferring the third toner image to the intermediate transfer member;

transferring to a recording sheet the toner images superimposed on the intermediate transfer member in the order of the first toner image, second toner image and third toner image from the surface of the intermediate transfer member; and heat-and-pressure fixing to the recording sheet the toner images superimposed on the recording sheet in the order of the third toner image, second toner image and first toner image from the surface of the recording sheet, by a heat-and-pressure fixing means to form a multi-color image or full-color image on the recording sheet;

wherein;

the toners forming the first toner image, second toner image and third toner image each contain a vinyl polymer cross-linked with a cross-linking agent or a vinyl copolymer cross-linked with a cross-linking agent; the amount of the cross-linking agent in the third toner, second toner and first toner being made larger in this order;

the first toner is a color toner selected from the group consisting of a yellow toner having yellow toner particles and an external additive, a cyan toner having cyan toner particles and an external additive and a magenta toner having magenta toner particles and an external additive;

the second toner is a color toner selected from the group consisting of a yellow toner having yellow toner particles and an external additive, a cyan toner having cyan toner particles and an external additive and a magenta toner having magenta toner particles and an external additive;

the third toner is a color toner selected from the group consisting of a yellow toner having yellow toner particles and an external additive, a cyan toner having cyan toner particles and an external additive and a magenta toner having magenta toner particles and an external additive; and the first toner, second toner and third toner have colors different from one another.

2. The image forming method according to claim 1, wherein said cross-linking agent is contained in an amount of from 0.01 part by weight to 1.0 part by weight based on 100 parts by weight of the vinyl polymer or vinyl copolymer.

3. The image forming method according to claim 1, wherein said cross-linking agent is contained in an amount of from 0.1 part by weight to 0.9 part by weight based on 100 parts by weight of the vinyl polymer or vinyl copolymer.

4. The image forming method according to claim 1, wherein said first toner, second toner and third toner are toners produced by suspension polymerization in an aqueous medium.

5. The image forming method according to claim 1, wherein said first toner, second toner and third toner each have a weight-average particle diameter of from 4 $\mu$m to 8 $\mu$m.

6. The image forming method according to claim 1, wherein said first toner, second toner and third toner each have a variation coefficient of 35% or less in number distribution.

7. The image forming method according to claim 1, wherein said first toner, second toner and third toner each have an average circularity of from 0.920 to 0.995.

8. The image forming method according to claim 1, wherein said first toner, second toner and third toner each have an average circularity of from 0.950 to 0.995 and a circularity standard deviation of less than 0.040.

9. The image forming method according to claim 1, wherein said first toner, second toner and third toner each have an average circularity of from 0.950 to 0.995 and a circularity standard deviation of from 0.015 to 0.035.

10. The image forming method according to claim 1, wherein said first toner, second toner and third toner each contain a wax.

11. The image forming method according to claim 10, wherein said wax is an ester wax.

12. The image forming method according to claim 10, wherein said wax is contained in an amount of from 5% by weight to 30% by weight in the toner.

13. An image forming method comprising:

forming a first electrostatic latent image on a latent image bearing member, developing the first electrostatic latent image by the use of a first toner to form a first toner image on the latent image bearing member and transferring the first toner image to a recording sheet;

forming a second electrostatic latent image on the latent image bearing member, developing the second electrostatic latent image by the use of a second toner to form a second toner image on the latent image bearing member and transferring the second toner image to the recording sheet;

forming a third electrostatic latent image on the latent image bearing member, developing the third electrostatic latent image by the use of a third toner to form a third toner image on the latent image bearing member and transferring the third toner image to the recording sheet; and heat-and-pressure fixing to the recording sheet the toner images superimposed on the recording sheet in the order of the first toner image, second toner image and third toner image from the surface of the recording sheet, by a heat-and-pressure fixing means to form a multi-color image or full-color image on the recording sheet;

wherein;

the toners forming the first toner image, second toner image and third toner image each contain a vinyl polymer cross-linked with a cross-linking agent or a vinyl copolymer cross-linked with a cross-linking agent; the amount of the cross-linking agent in the first toner, second toner and third toner being made larger in this order;

the first toner is a color toner selected from the group consisting of a yellow toner having yellow toner particles and an external additive, a cyan toner having cyan toner particles and an external additive and a magenta toner having magenta toner particles and an external additive;

the second toner is a color toner selected from the group consisting of a yellow toner having yellow toner particles and an external additive, a cyan toner having cyan toner particles and an external additive and a magenta toner having magenta toner particles and an external additive;

the third toner is a color toner selected from the group consisting of a yellow toner having yellow toner particles and an external additive, a cyan toner having cyan toner particles and an external additive and a magenta toner having magenta toner particles and an external additive; and the first toner, second toner and third toner have colors different from one another.

14. The image forming method according to claim 13, wherein said cross-linking agent is contained in an amount of from 0.01 part by weight to 1.0 part by weight based on 100 parts by weight of the vinyl polymer or vinyl copolymer.

15. The image forming method according to claim 13, wherein said cross-linking agent is contained in an amount of from 0.1 part by weight to 0.9 part by weight based on 100 parts by weight of the vinyl polymer or vinyl copolymer.

16. The image forming method according to claim 13, wherein said first toner, second toner and third toner are toners produced by suspension polymerization in an aqueous medium.

17. The image forming method according to claim 13, wherein said first toner, second toner and third toner each have a weight-average particle diameter of from 4 $\mu$m to 8 $\mu$m.

18. The image forming method according to claim 13, wherein said first toner, second toner and third toner each have a variation coefficient of 35% or less in number distribution.

19. The image forming method according to claim 13, wherein said first toner, second toner and third toner each have an average circularity of from 0.920 to 0.995.

20. The image forming method according to claim 13, wherein said first toner, second toner and third toner each have an average circularity of from 0.950 to 0.995 and a circularity standard deviation of less than 0.040.

21. The image forming method according to claim 13, wherein said first toner, second toner and third toner each have an average circularity of from 0.950 to 0.995 and a circularity standard deviation of from 0.015 to 0.035.

22. The image forming method according to claim 13, wherein said first toner, second toner and third toner each contain a wax.

23. The image forming method according to claim 22, wherein said wax is an ester wax.

24. The image forming method according to claim 22, wherein said wax is contained in an amount of from 5% by weight to 30% by weight in the toner.

25. An image forming method comprising:

forming a first electrostatic latent image on a latent image bearing member, developing the first electrostatic latent image by the use of a first toner to form a first toner image on the latent image bearing member and transferring the first toner image to an intermediate transfer member;

forming a second electrostatic latent image on the latent image bearing member, developing the second electrostatic latent image by the use of a second toner to form a second toner image on the latent image bearing member and transferring the second toner image to the intermediate transfer member;

forming a third electrostatic latent image on the latent image bearing member, developing the third electrostatic latent image by the use of a third toner to form a third toner image on the latent image bearing member and transferring the third toner image to the intermediate transfer member;

forming a fourth electrostatic latent image on the latent image bearing member, developing the fourth electrostatic latent image by the use of a fourth toner to form a fourth toner image on the latent image bearing member and transferring the fourth toner image to the intermediate transfer member;

transferring to a recording sheet the toner images superimposed on the intermediate transfer member in the order of the first toner image, second toner image, third toner image and fourth toner image from the surface of the intermediate transfer member; and heat-and-pressure fixing to the recording sheet the toner images superimposed on the recording sheet in the order of the fourth toner image, third toner image, second toner image and first toner image from the surface of the recording sheet, by a heat-and-pressure fixing means to form a multi-color image or full-color image on the recording sheet;

wherein;

the toners forming the first toner image, second toner image, third toner image and the fourth toner image each contain a vinyl polymer cross-linked with a cross-linking agent or a vinyl copolymer cross-linked with a cross-linking agent; the amount of the cross-linking agent in the fourth toner, third toner, second toner and first toner being made larger in this order;

the first toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the second toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the third toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the fourth toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive; and the first toner, second toner, third toner and fourth toner have colors different from one another.

26. The image forming method according to claim 25, wherein said cross-linking agent is contained in an amount of from 0.01 part by weight to 1.0 part by weight based on 100 parts by weight of the vinyl polymer or vinyl copolymer.

27. The image forming method according to claim 25, wherein said cross-linking agent is contained in an amount of from 0.1 part by weight to 0.9 part by weight based on 100 parts by weight of the vinyl polymer or vinyl copolymer.

28. The image forming method according to claim 25, wherein said first toner, second toner, third toner and fourth toner are toners produced by suspension polymerization in an aqueous medium.

29. The image forming method according to claim 25, wherein said first toner is a pulverization toner and said second toner, third toner and fourth toner are toners produced by suspension polymerization in an aqueous medium.

30. The image forming method according to claim 29, wherein said first toner is the black toner having black toner particles and an external additive.

31. The image forming method according to claim 25, wherein said second toner, third toner and fourth toner each have a weight-average particle diameter of from 4 $\mu$m to 8 $\mu$m.

32. The image forming method according to claim 25, wherein said first toner, second toner, third toner and fourth toner each have a weight-average particle diameter of from 4 $\mu$m to 8 $\mu$m.

33. The image forming method according to claim 25, wherein said second toner, third toner and fourth toner each have a variation coefficient of 35% or less in number distribution.

34. The image forming method according to claim 25, wherein said first toner, second toner, third toner and fourth toner each have a variation coefficient of 35% or less in number distribution.

35. The image forming method according to claim 25, wherein said second toner, third toner and fourth toner each have an average circularity of from 0.920 to 0.995.

36. The image forming method according to claim 25, wherein said first toner, second toner, third toner and fourth toner each have an average circularity of from 0.920 to 0.995.

37. The image forming method according to claim 25, wherein said second toner, third toner and fourth toner each have an average circularity of from 0.950 to 0.995 and a circularity standard deviation of less than 0.040.

38. The image forming method according to claim 25, wherein said first toner, second toner, third toner and fourth toner each have an average circularity of from 0.950 to 0.995 and a circularity standard deviation of less than 0.040.

39. The image forming method according to claim 25, wherein said second toner, third toner and fourth toner each have an average circularity of from 0.950 to 0.995 and a circularity standard deviation of from 0.015 to 0.035.

40. The image forming method according to claim 25, wherein said first toner, second toner, third toner and fourth toner each have an average circularity of from 0.950 to 0.995 and a circularity standard deviation of from 0.015 to 0.035.

41. The image forming method according to claim 25, wherein said first toner, second toner, third toner and fourth toner each contain a wax.

42. The image forming method according to claim 41, wherein said wax is contained in an amount of from 5% by weight to 30% by weight in the toner.

43. The image forming method according to claim 25, wherein said second toner, third toner and fourth toner each contain a wax, and the wax is an ester wax.

44. An image forming method comprising;

forming a first electrostatic latent image on a latent image bearing member, developing the first electrostatic latent image by the use of a first toner to form a first toner image on the latent image bearing member and transferring the first toner image to a recording sheet;

forming a second electrostatic latent image on the latent image bearing member, developing the second electrostatic latent image by the use of a second toner to form a second toner image on the latent image bearing member and transferring the second toner image to the recording sheet;

forming a third electrostatic latent image on the latent image bearing member, developing the third electrostatic latent image by the use of a third toner to form a third toner image on the latent image bearing member and transferring the third toner image to the recording sheet;

forming a fourth electrostatic latent image on the latent image bearing member, developing the fourth electrostatic latent image by the use of a fourth toner to form a fourth toner image on the latent image bearing member and transferring the fourth toner image to the recording sheet; and heat-and-pressure fixing to the recording sheet the toner images superimposed on the recording sheet in the order of the first toner image, second toner image, third toner image and fourth toner image from the surface of the recording sheet, by a heat-and-pressure fixing means to form a multi-color image or full-color image on the recording sheet;

wherein;

the toners forming the first toner image, second toner image, third toner image and the fourth toner image each contain a vinyl polymer cross-linked with a cross-linking agent or a vinyl copolymer cross-linked with a cross-linking agent; the amount of the cross-linking agent in the first toner, second toner, third toner and fourth toner being made larger in this order;

the first toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the second toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the third toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive;

the fourth toner is a toner selected from the group consisting of a yellow toner having yellow toner particles and an external additive, a cyan toner having cyan toner particles and an external additive, a magenta toner having magenta toner particles and an external additive and a black toner having black toner particles and an external additive; and the first toner, second toner, third toner and fourth toner have colors different from one another.

45. The image forming method according to claim 44, wherein said cross-linking agent is contained in an amount of from 0.01 part by weight to 1.0 part by weight based on 100 parts by weight of the vinyl polymer or vinyl copolymer.

46. The image forming method according to claim 44, wherein said cross-linking agent is contained in an amount of from 0.1 part by weight to 0.9 part by weight based on 100 parts by weight of the vinyl polymer or vinyl copolymer.

47. The image forming method according to claim 44, wherein said first toner, second toner, third toner and fourth toner are toners produced by suspension polymerization in an aqueous medium.

48. The image forming method according to claim 44, wherein said first toner, second toner and third toner are toners produced by suspension polymerization in an aqueous medium, and said fourth toner is a pulverization toner.

49. The image forming method according to claim 48, wherein said fourth toner is the black toner having black toner particles and an external additive.

50. The image forming method according to claim 44, wherein said first toner, second toner and third toner each have a weight-average particle diameter of from 4 $\mu$m to 8 $\mu$m.

51. The image forming method according to claim 44, wherein said first toner, second toner, third toner and fourth toner each have a weight-average particle diameter of from 4 $\mu$m to 8 $\mu$m.

52. The image forming method according to claim 44, wherein said first toner, second toner and third toner each have a coefficient of variation in number distribution, of 35% or less.

53. The image forming method according to claim 44, wherein said first toner, second toner, third toner and fourth toner each have a variation coefficient of 35% or less in number distribution.

54. The image forming method according to claim 44, wherein said first toner, second toner and third toner toner each have an average circularity of from 0.920 to 0.995.

55. The image forming method according to claim 44, wherein said first toner, second toner, third toner and fourth toner each have an average circularity of from 0.920 to 0.995.

56. The image forming method according to claim 44, wherein said first toner, second toner and third toner toner each have an average circularity of from 0.950 to 0.995 and a circularity standard deviation of less than 0.040.

57. The image forming method according to claim 44, wherein said first toner, second toner, third toner and fourth toner each have an average circularity of from 0.950 to 0.995 and a circularity standard deviation of less than 0.040.

58. The image forming method according to claim 44, wherein said first toner, second toner and third toner each have an average circularity of from 0.950 to 0.995 and a circularity standard deviation of from 0.015 to 0.035.

59. The image forming method according to claim 44, wherein said first toner, second toner, third toner and fourth toner each have an average circularity of from 0.950 to 0.995 and a circularity standard deviation of from 0.015 to 0.035.

60. The image forming method according to claim 44, wherein said first toner, second toner, third toner and fourth toner each contain a wax.

61. The image forming method according to claim 60, wherein said wax is contained in an amount of from 5% by weight to 30% by weight in the toner.

62. The image forming method according to claim 44, wherein said first toner, second toner and third toner each contain a wax, and the wax is an ester wax.

* * * * *

UNITED STATES PATENT AND TRADEMARK OFFICE

CERTIFICATE OF CORRECTION

PATENT NO. :6,051,350

DATED :April 18, 2000

INVENTOR(S) :Koji Inaba et al.

It is certified that error appears in the above-identified patent and that said Letters Patent is hereby corrected as shown below:

ON THE TITLE PAGE:

[73] Assignee,

"Canon Kabushiki Kaisha" should read --Canon Kabushiki Kaisha, Tokyo, Japan--.

COLUMN 1:

Line 40, "are" should read --is--.

COLUMN 2:

Line 40, "less cause" should read --cause less--;
Line 46, "cardboad." should read --cardboard.--; and
Line 50, "cardboad." should read --cardboard.--.

COLUMN 7:

Line 8, "cardboad." should read --cardboard.--.

COLUMN 12:

Line 14, "mount" should read --amount--.

COLUMN 14:

Line 11, "an" (first occurrence) should be deleted.

COLUMN 16:

Line 16, "of" (first occurrence) should be deleted.

UNITED STATES PATENT AND TRADEMARK OFFICE

CERTIFICATE OF CORRECTION

PATENT NO. :6,051,350

DATED :April 18, 2000

INVENTOR(S) :Koji Inaba et al.

It is certified that error appears in the above-identified patent and that said Letters Patent is hereby corrected as shown below:

COLUMN 21:

Line 43, "are" should be deleted.

COLUMN 25:

Line 28, "less occur." should read --occur less.--; and
Line 46, "less occur." should read --occur less.--.

COLUMN 26:

Line 14, "a" should be deleted.

COLUMN 30:

Line 51, "250 μm)." should read --250 μm.--; and
Line 53, "may" should read --may be--.

COLUMN 33:

Line 5, "tend" should read --tends--.

COLUMN 36:

Line 25, "change" should read --changed--; and
Line 31, "change" should read --changed--.

COLUMN 38:

Line 43, "acid)" should read --acid--.

UNITED STATES PATENT AND TRADEMARK OFFICE

CERTIFICATE OF CORRECTION

PATENT NO. : 6,051,350

DATED : April 18, 2000

INVENTOR(S) : Koji Inaba et al.

It is certified that error appears in the above-identified patent and that said Letters Patent is hereby corrected as shown below:

COLUMN 40:

Line 13, "styrene" should read --Styrene--;
Line 17, "aluminum" should read --Aluminum--; and
"acid)" should read --acid--;
Line 18, "divinylbenzene" should read
--Divinylbenzene--;
Line 19, "ester" should read --Ester--; and
Line 38, "acid)" should read --acid--.

COLUMN 52:

Line 21, "toner" (third occurrence) should be deleted;
and
Line 29, "toner" (third occurrence) should be deleted.

Signed and Sealed this

Tenth Day of April, 2001

*Attest:*

Nicholas P. Godici

NICHOLAS P. GODICI

*Attesting Officer*

*Acting Director of the United States Patent and Trademark Office*